US011531286B2

(12) United States Patent
Shigihara et al.

(10) Patent No.: US 11,531,286 B2
(45) Date of Patent: Dec. 20, 2022

(54) IMAGE FORMING APPARATUS CAPABLE OF SUPPRESSING DETERIORATION IN ACCURACY OF CONTROLLING SWITCHING OF MOTORS FROM FORWARD ROTATION TO REVERSE ROTATION

(71) Applicant: CANON KABUSHIKI KAISHA, Tokyo (JP)

(72) Inventors: Keita Shigihara, Chiba (JP); Yuichi Tanabe, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/539,907

(22) Filed: Dec. 1, 2021

(65) Prior Publication Data

US 2022/0187731 A1 Jun. 16, 2022

(30) Foreign Application Priority Data

Dec. 11, 2020 (JP) ..... JP2020-206319

(51) Int. Cl.
*G03G 15/00* (2006.01)
*G03G 15/02* (2006.01)

(52) U.S. Cl.
CPC ..... *G03G 15/0258* (2013.01)

(58) Field of Classification Search
CPC ..... G03G 15/0216; G03G 15/5008; G03G 15/757; G03G 21/1661; G03G 21/1647
USPC ..... 399/115, 167
See application file for complete search history.

(56) References Cited

U.S. PATENT DOCUMENTS 8,041,262 B2 * 10/2011 Carter et al. ..... G03G 15/0126 399/167
10,114,315 B2 * 10/2018 Morita ..... G03G 15/757
11,119,423 B2 * 9/2021 Tan ..... G03G 15/0216
2018/0283459 A1 * 10/2018 Carter ..... G03G 15/757

FOREIGN PATENT DOCUMENTS

JP 08-234643 A 9/1996

* cited by examiner

*Primary Examiner* — William J Royer
(74) *Attorney, Agent, or Firm* — Venable LLP

(57) ABSTRACT

An image forming apparatus is capable of suppressing deterioration in accuracy of control for switching a motor from forward to reverse rotation in a configuration in which a coupling having play in a rotation direction is interposed in a drive train between the motor and a driven member. The image forming apparatus includes a motor that rotationally drives a photosensitive drum and a developing sleeve; a coupling interposed in a drive train between the motor and the developing sleeve and/or a drive train between the motor and the photosensitive drum and having play in a rotation direction; and a CPU that controls the motor. The CPU rotates the motor forward at a speed V1 at the time of image formation, stops the motor after the end of the image formation, rotates the motor forward at a speed V2 lower than the speed V1, and then reversely rotates the motor.

16 Claims, 18 Drawing Sheets

IMAGE FORMING APPARATUS CAPABLE OF SUPPRESSING DETERIORATION IN ACCURACY OF CONTROLLING SWITCHING OF MOTORS FROM FORWARD ROTATION TO REVERSE ROTATION

BACKGROUND OF THE INVENTION

Field of the Invention

The present invention relates to an image forming apparatus such as an electrophotographic copying machine or an electrophotographic printer (for example, a laser beam printer, an LED printer, or the like).

Description of the Related Art

In an image forming apparatus of an electrophotographic system, an electrostatic latent image is formed on a surface of a photosensitive drum, and the formed electrostatic latent image is developed by a developing unit to form an image. Japanese Patent Application Laid-Open No. 8-234643 describes a configuration in which both a photosensitive drum and a developing sleeve included in a developing unit are rotated using one motor. By driving a plurality of members with one motor as described above, it is possible to reduce the size and cost of an image forming apparatus, as compared with a configuration using a plurality of motors.

Japanese Patent Application Laid-Open No. 8-234643 describes a configuration for selectively rotating the photosensitive drum and the developing sleeve. In the configuration described in Japanese Patent Application Laid-Open No. 8-234643, a coupling having play, which is a predetermined rotation angle, is provided in a transmission mechanism that transmits power between a drive source and the developing sleeve. With such a configuration, in a state the motor is rotated forward, both the photosensitive drum and the developing sleeve rotate. In a state the motor is reversely rotated by the predetermined rotation angle, the developing sleeve does not rotate, and the photosensitive drum rotates in a direction opposite to a rotation direction in a state the motor rotates forward.

In the configuration described in Japanese Patent Application Laid-Open No. 8-234643, in a state the motor is stopped in order to switch the motor from the forward rotation to the reverse rotation, the photosensitive drum and the developing sleeve, which are driven members, rotate by inertia after the stop of the motor. Due to the rotation of the driven members by the inertia, the stop position of the coupling having the play in the rotation direction and interposed in a drive train between the motor and the driven member is shifted from an ideal stop position where the coupling is in a backlash-reduced state in the rotation direction at the time of the forward rotation of the motor. In a state the motor is reversely rotated in a state in which the stop position of the coupling is shifted from the ideal stop position as described above, the time in a state the driven members start reversely rotating deviates from an ideal time, and the accuracy of controlling the reverse rotation deteriorates.

Therefore, it is desirable to provide an image forming apparatus capable of suppressing deterioration in the accuracy of controlling reverse rotation of a motor in a configuration in which a coupling having play in a rotation direction is interposed in a drive train between the motor and a driven member.

SUMMARY OF THE INVENTION

To achieve the above object, as a typical configuration, an image forming apparatus according to the present invention includes: a photoreceptor; a charging roller that rotates in contact with the photoreceptor and charges the photoreceptor; a developer carrier that carries a developer and develops an electrostatic latent image formed on the photoreceptor; a motor that rotatably drives the photoreceptor and the developer carrier; a coupling provided in at least one of a first drive train that transmits drive from the motor to the developer carrier or a second drive train that transmits drive from the motor to the photoreceptor, the coupling having play in a rotation direction of the coupling; a controller that controls the motor such that the motor rotates in a first rotation direction and a second rotation direction opposite to the first rotation direction; and a separating member that separates the charging roller from the photoreceptor in accordance with the rotation of the motor in the second rotation direction, wherein the developer carrier is rotated in accordance with the rotation of the motor in the first rotation direction to develop the electrostatic latent image formed on the photoreceptor, and is rotated in a direction opposite to the rotation in a case where the electrostatic latent image is developed in accordance with the rotation of the motor in the second rotation direction, the controller rotates the motor in the second rotation direction by a predetermined amount to rotate the developer carrier in the direction opposite to the rotation in the case where the electrostatic latent image is developed without causing the separating member to operate to separate the charging roller from the photoreceptor, and the controller rotates the motor in the first rotation direction so as to maximize the play of the coupling from a state in which the rotation of the motor is stopped, and then rotates the motor in the second rotation direction.

Further features of the present invention will become apparent from the following description of exemplary embodiments (with reference to the attached drawings).

and

Figure 17A:
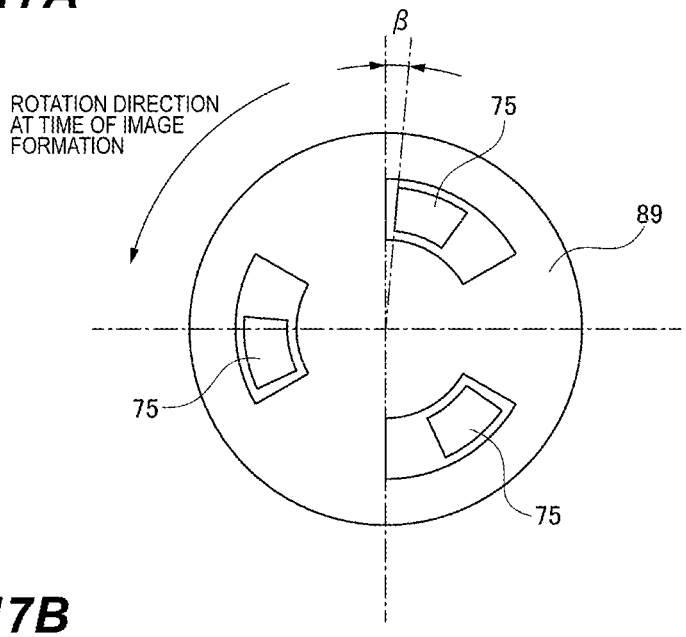
Figure 17B:
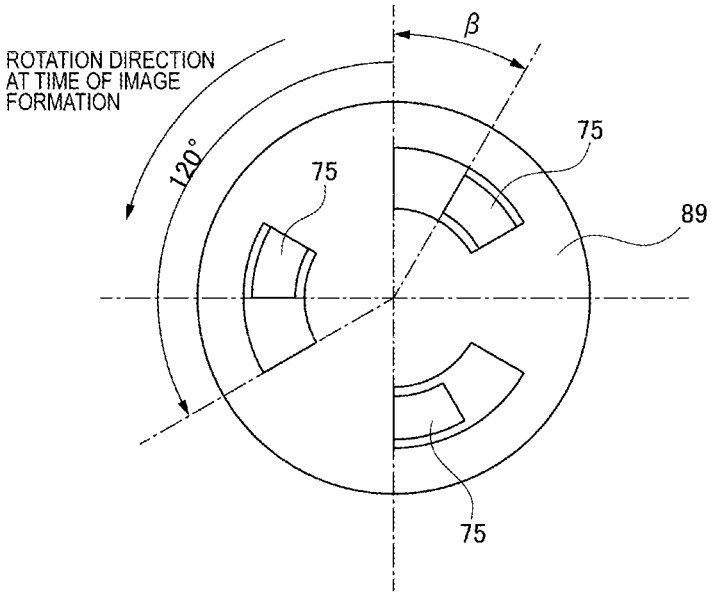

FIGS. 17A and 17B are diagrams illustrating positional relationships between the developing coupling and the drive coupling.

DESCRIPTION OF THE EMBODIMENTS

<Image Forming Apparatus>

Hereinafter, an overall configuration of an image forming apparatus according to the present invention will be described with reference to the drawings together with an operation at the time of image formation. The dimensions, materials, shapes, relative arrangements, and the like of components described below are not intended to limit the scope of the present invention only to them unless otherwise specified.

An image forming apparatus A according to the present embodiment is an intermediate tandem type image forming apparatus that transfers toner of four colors of yellow Y, magenta M, cyan C, and black K as a developer to an intermediate transfer belt, and then transfers an image to a sheet to form an image. In the following description, Y, M, C, and K are added as suffixes to members that use the toner of the respective colors, but the configurations and operations of the members are substantially the same except that the colors of the toner to be used are different, and thus the suffixes are appropriately omitted unless distinction is required.

Figure 1:
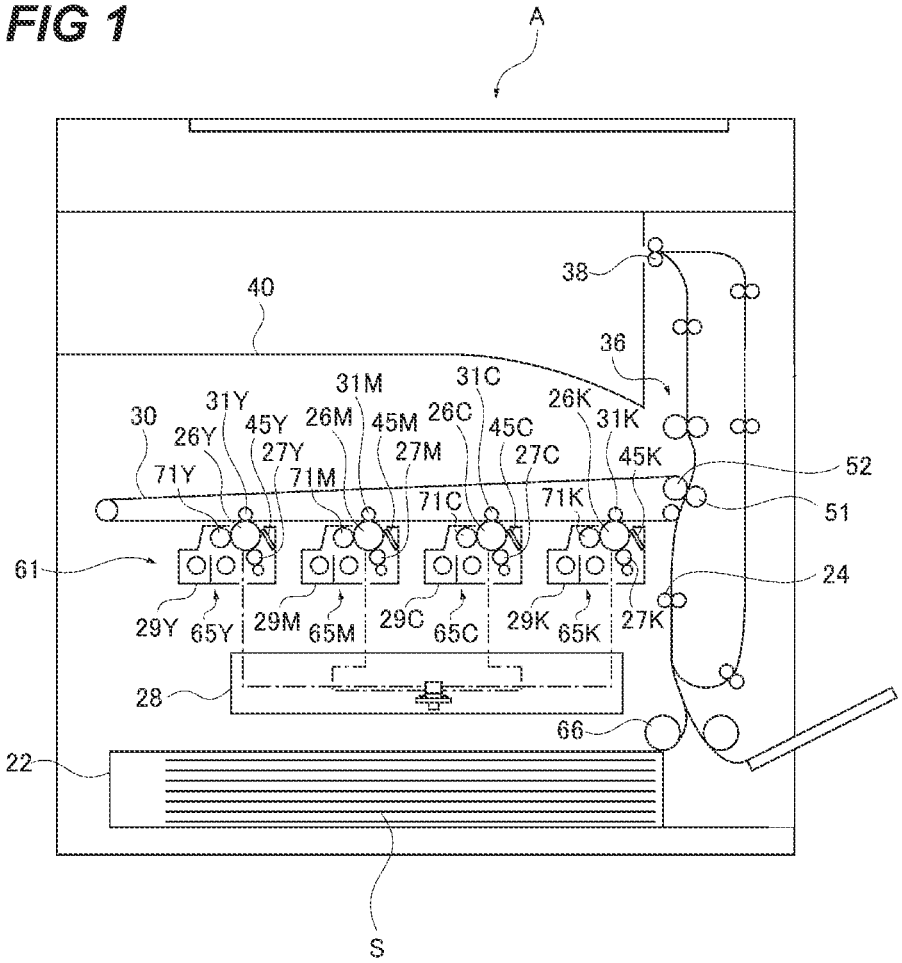
FIG. 1 is a schematic cross-sectional view of an image forming apparatus.

FIG. 1 is a schematic cross-sectional view of the image forming apparatus A. As illustrated in FIG. 1, the image forming apparatus A includes an image forming portion 61 that forms an image on a sheet S. The image forming portion 61 includes a process cartridge 65 (65Y, 65M, 65C, 65K), a laser scanner unit 28, a primary transfer roller 31 (31Y, 31M, 31C, 31K), an intermediate transfer belt 30, a secondary transfer roller 51, and a secondary transfer counter roller 52.

Each process cartridge 65 (image forming unit) is configured to be detachably attachable to the image forming apparatus A. Each process cartridge 65 includes a photosensitive drum 26 (26Y, 26M, 26C, 26K) as a photoreceptor and a charging roller 27 (27Y, 27M, 27C, 27K). Each process cartridge 65 includes a developing unit 29 (29Y, 29M, 29C, 29K) having a developing sleeve 71 (71Y, 71M, 71C, 71K) as a developer carrier, and a cleaning blade 45 (45Y, 45M, 45C, 45K). That is, the photosensitive drum 26, the charging roller 27, the developing sleeve 71, and the cleaning blade 45 are integrated as the process cartridge 65.

Next, an image forming operation will be described. First, when a controller (not illustrated) receives an image forming job signal, the sheet S stacked and stored in a sheet cassette 22 is conveyed to a registration roller 24 by a feeding roller 66. Thereafter, the registration roller 24 conveys the sheet S to a secondary transfer portion formed by the secondary transfer roller 51 and the secondary transfer counter roller 52 at a predetermined time.

On the other hand, in the image forming portion 61, first, the surface of the photosensitive drum 26Y is charged by the charging roller 27Y. Thereafter, the laser scanner unit 28 irradiates the surface of the photosensitive drum 26Y with laser light according to image data input from an external device (not illustrated). As a result, an electrostatic latent image corresponding to the image data is formed on the surface of the photosensitive drum 26Y.

Next, the developing sleeve 71Y of the developing unit 29Y causes yellow toner to adhere to the electrostatic latent image formed on the surface of the photosensitive drum 26Y to form a yellow toner image (developer image) on the surface of the photosensitive drum 26Y. The toner image formed on the surface of the photosensitive drum 26Y is primarily transferred to the intermediate transfer belt 30 by applying a bias to the primary transfer roller 31Y. Thereafter, the toner remaining on the surface of the photosensitive drum 26Y is scraped off by the cleaning blade 45Y. Note that the cleaning blade 45Y abuts the surface of the photosensitive drum 26Y so as to be counter with respect to the rotation direction of the photosensitive drum 26Y at the time of image formation.

By a similar process, magenta, cyan, and black toner images are also formed on the photosensitive drums 26M, 26C, and 26K. By applying a bias to the primary transfer rollers 31M, 31C, and 31K, these toner images are transferred and superimposed on the yellow toner image on the intermediate transfer belt 30. As a result, a full-color toner image is formed on the surface of the intermediate transfer belt 30. Thereafter, the toner remaining on the surfaces of the photosensitive drums 26M, 26C, and 26K is scraped off by the cleaning blades 45M, 45C, and 45K.

The intermediate transfer belt 30 circulates following the rotation of the secondary transfer counter roller 52. When the intermediate transfer belt 30 carrying the full-color toner image moves, the toner image is sent to the secondary transfer portion. In the secondary transfer portion, a bias is applied to the secondary transfer roller 51, whereby the toner image on the intermediate transfer belt 30 is transferred to the sheet S.

Next, the sheet S to which the toner image has been transferred is conveyed to a fixing portion 36, and is subjected to heating and pressure treatment in the fixing portion 36, whereby the toner image on the sheet S is fixed to the sheet S. Thereafter, the sheet S on which the toner image has been fixed is discharged to a discharge tray 40 by a discharge roller 38.

<Controller>

Next, a system configuration of the image forming apparatus A will be described.

Figure 2:
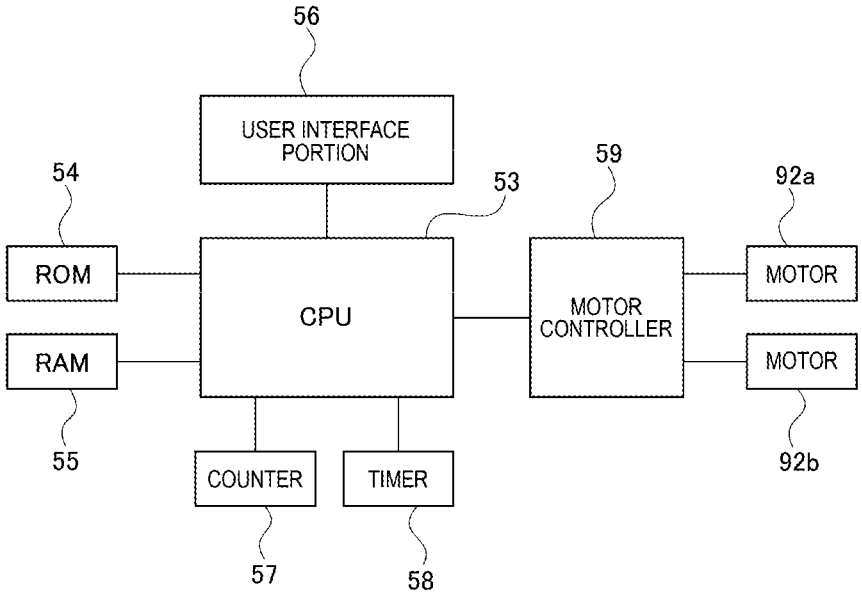
FIG. 2 is a block diagram illustrating a system configuration of the image forming apparatus.

FIG. 2 is a block diagram illustrating the system configuration of the image forming apparatus A. As illustrated in FIG. 2, the image forming apparatus A includes a CPU 53 (controller), a ROM 54, a RAM 55, a user interface portion 56, a counter 57, a timer 58, and a motor controller 59.

The ROM 54 stores various data and control programs such as a firmware program and a boot program for controlling the firmware program. The RAM 55 has a program load area, a work area, a storage area for various data, and the like. The CPU 53 controls each device of the image forming apparatus A while using the RAM 55 as a work area or a temporary storage area of data based on various control programs stored in the ROM 54.

The user interface portion 56 is connected to an operation portion (not illustrated) of a touch panel system and to an external device such as a PC via an Internet line, receives various jobs from a user via the operation portion and the external device, and transmits the various jobs to the CPU 53. The counter 57 counts the number of sheets on which an image has been formed by the image forming apparatus A, and transmits the counted value to the CPU 53. The timer 58 measures time in accordance with an instruction from the CPU 53.

The motor controller 59 controls a motor 92*a* that is a drive source for driving the photosensitive drums 26Y, 26M, and 26C and the developing sleeves 71Y, 71M, and 71C, and a motor 92*b* that is a drive source for driving the photosensitive drum 26K and the developing sleeve 71K. The CPU 53 instructs the motor controller 59 to control the motors 92*a* and 92*b*, and controls the motors 92*a* and 92*b* via the motor controller 59.

<Process Cartridge>

Next, a configuration of the process cartridge 65 will be described.

Figure 3:
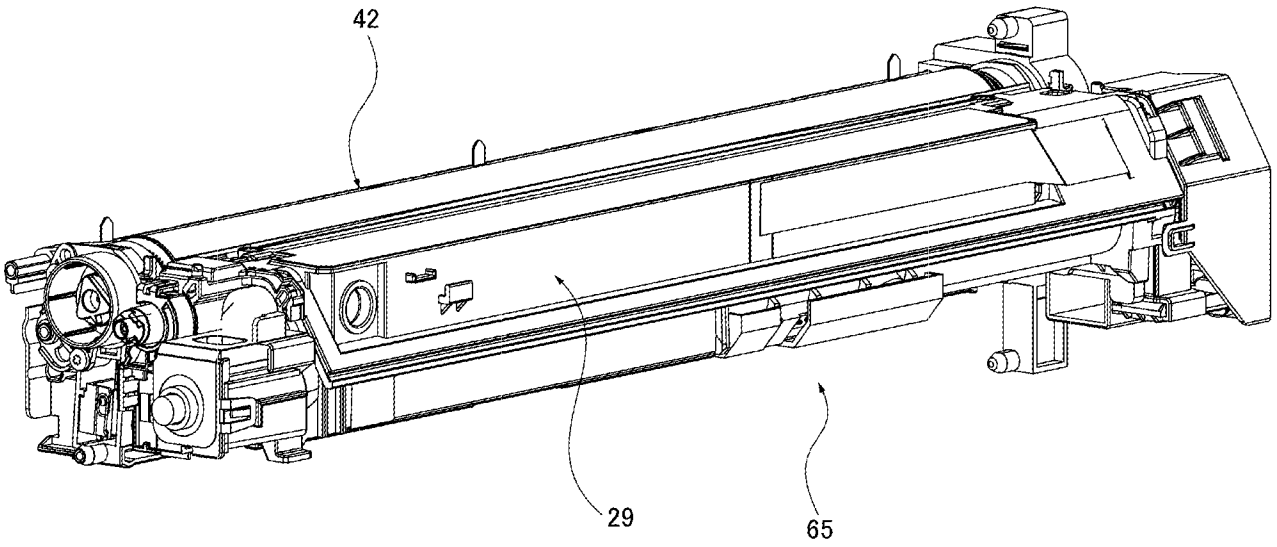
FIG. 3 is a perspective view of a process cartridge.
Figure 4:
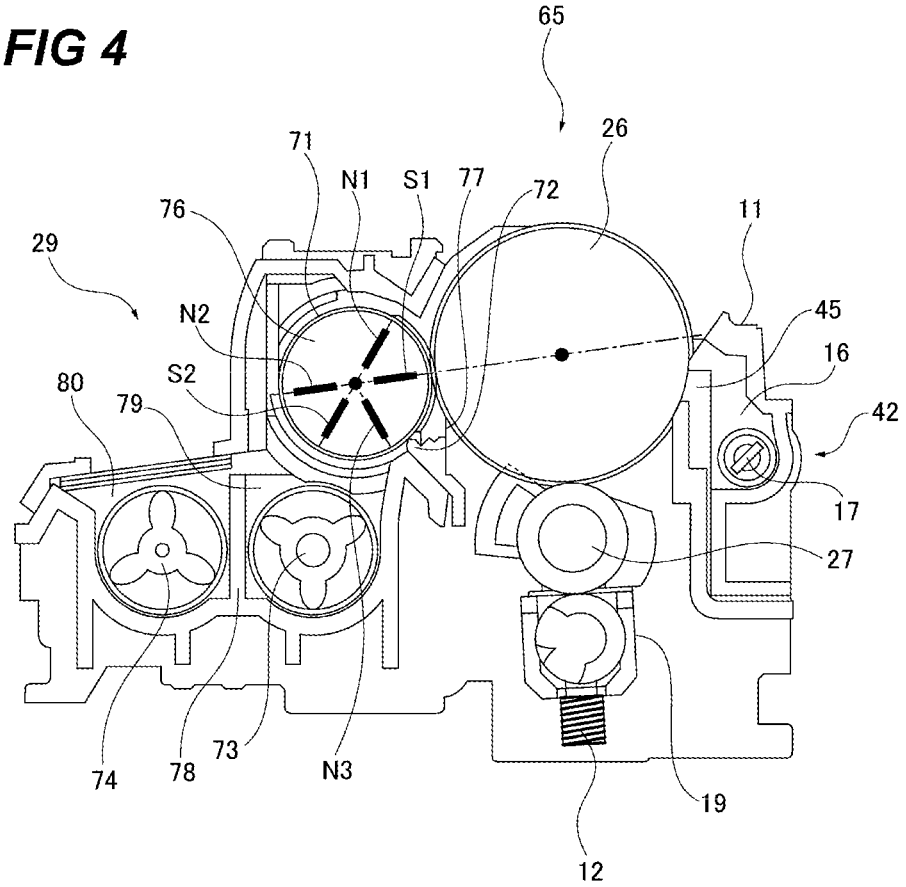
FIG. 4 is a cross-sectional view of the process cartridge.

FIG. 3 is a perspective view of the process cartridge 65. FIG. 4 is a cross-sectional view of the process cartridge 65. As illustrated in FIGS. 3 and 4, the process cartridge 65 includes a drum unit 42 and a developing unit 29.

Figure 5:
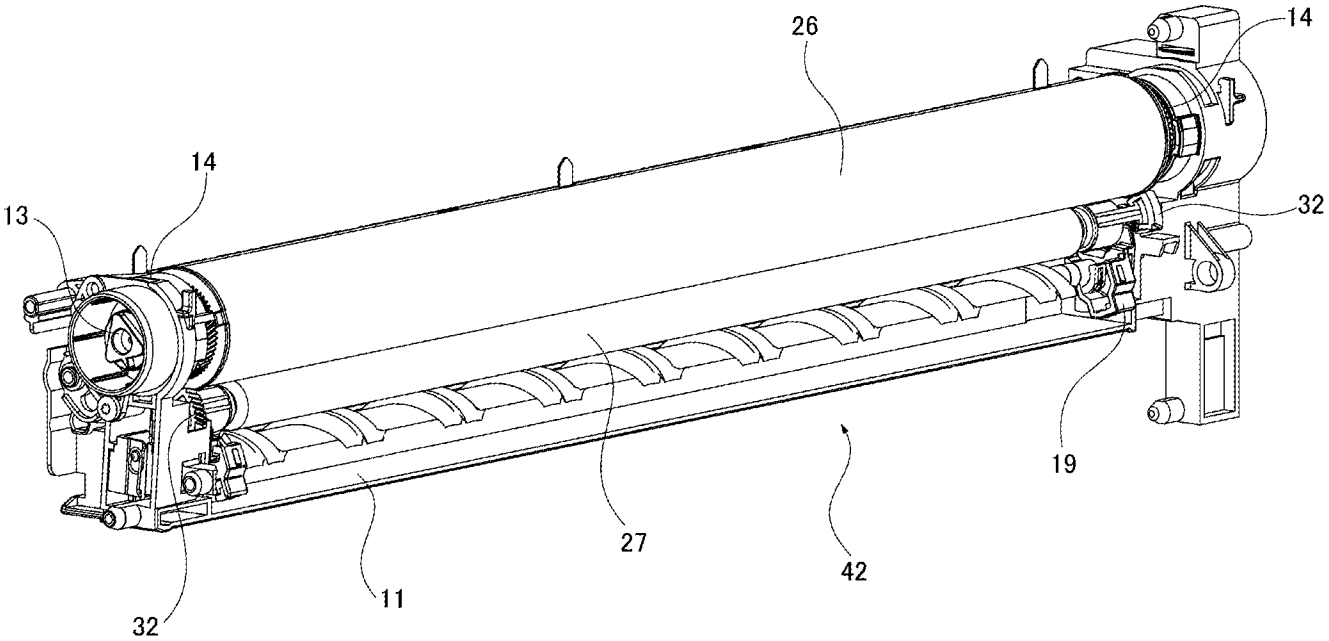
FIG. 5 is a perspective view of a drum unit.

First, the configuration of the drum unit 42 will be described. FIG. 5 is a perspective view of the drum unit 42. FIGS. 6A to 6D are cross-sectional views of the periphery of the photosensitive drum 26 in the drum unit 42, and illustrate how the charging roller 27 is separated from the photosensitive drum 26 in the order of FIGS. 6A to 6D. As illustrated in FIGS. 5 and 6A to 6D, the drum unit 42 includes the photosensitive drum 26, the charging roller 27, and the cleaning blade 45, which are integrally held by a drum container 11.

The drum container 11 rotatably holds the photosensitive drum 26. On one end side of the drum container 11 in the rotational axis direction of the photosensitive drum 26, a drum coupling 13 that receives a driving force from a drive unit 90 (to be described later) is provided integrally with the photosensitive drum 26. The drum coupling 13 is disposed in the drum container 11 on the back side of the image forming apparatus A. A flange gear 14 is provided integrally with the photosensitive drum 26 at each of both ends of the photosensitive drum 26 in the rotational axis direction of the photosensitive drum 26.

The drum container 11 is provided with a collecting portion 16 (FIG. 4) that collects the toner removed from the surface of the photosensitive drum 26 by the cleaning blade 45. A conveying screw 17 that conveys the toner collected in the collecting portion 16 to the outside of the drum unit 42 is provided in the collecting portion 16. The conveying screw 17 is rotated by transmission of a driving force from the flange gear 14 via an idler gear 67 to convey the toner. The toner conveyed to the outside of the drum unit 42 by the conveying screw 17 is collected in a container (not illustrated) provided in the image forming apparatus A.

The drum container 11 is provided with a bearing 19 that rotatably holds the charging roller 27. The bearing 19 is held in the drum container 11 so as to be slidable in a direction approaching or separating from the photosensitive drum 26, and is biased toward the photosensitive drum 26 by a spring 12. Due to this biasing force, the charging roller 27 presses the photosensitive drum 26 and rotates following the rotation of the photosensitive drum 26.

A one-way clutch 21 is provided at each of both ends of the charging roller 27. When torque in a direction opposite to the rotation direction of the charging roller 27 at the time of image formation is applied, the one-way clutch 21 becomes a locked state and rotates integrally with the charging roller 27. In addition, when predetermined or more torque (idling torque) in the same direction as the rotation direction of the charging roller 27 at the time of image formation is applied, the locked state of the one-way clutch 21 is released, a driving force is not transmitted to the charging roller 27, and the one-way clutch 21 idly rotates. In the present embodiment, the one-way clutch 21 includes a latch projection and a rack.

On an outer peripheral portion of the one-way clutch 21 provided at each of both ends of the charging roller 27, a separating member 32 having a gear portion 32*a* that meshes with the flange gear 14 provided at each of both ends of the photosensitive drum 26 is provided. The separating member 32 and the one-way clutch 21 rotate integrally regardless of the rotation direction. That is, when the charging roller 27 rotates following the rotation of the photosensitive drum 26 in the direction opposite to the rotation direction at the time of image formation, the one-way clutch 21 and the separating member 32 rotate in conjunction therewith. The separating member 32 separates the charging roller 27 from the photosensitive drum 26 by a particular operation (to be described below) in order to prevent the charging roller 27 from being deformed and adversely affecting the image quality due to the charging roller 27 pressing the photosensitive drum 26 for a long time.

Figure 6A:
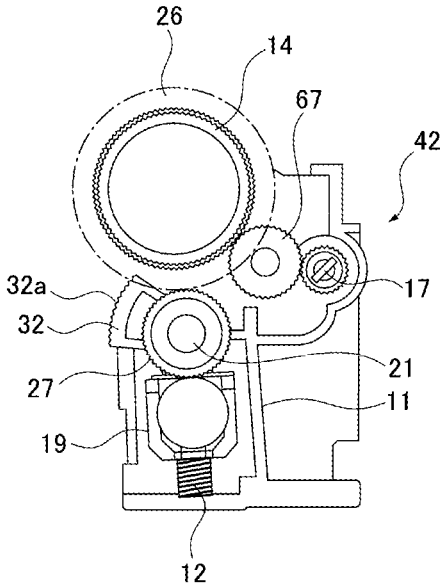
FIGS. 6A to 6D are cross-sectional views of the drum unit.
Figure 6B:
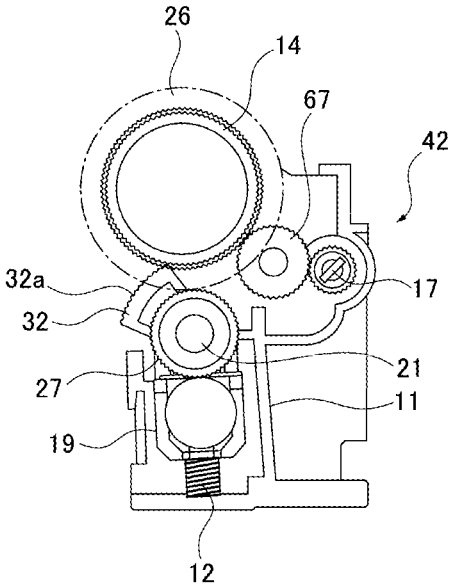

That is, as illustrated in FIG. 6A, while the image forming apparatus A performs the image forming operation, the gear portion 32*a* of the separating member 32 and the flange gear 14 are not meshed while being separated from each other. When a predetermined time elapses after the image forming apparatus A ends the image forming operation, the photosensitive drum 26 rotates in a direction opposite to the rotation direction at the time of image formation. As a result, the charging roller 27 also rotates following the rotation of the photosensitive drum 26 in the direction opposite to the rotation direction at the time of image formation, and the one-way clutch 21 and the separating member 32 also rotate. As illustrated in FIG. 6B, when the separating member 32 rotates, the gear portion 32*a* of the separating member 32 meshes with the flange gear 14. In the present embodiment, when the charging roller 27 rotates by an angle of 54 degrees, the one-way clutch 21 enters the locked state. As a result, the gear portion 32*a* of the separating member 32 that rotates integrally with the one-way clutch 21 meshes with the flange gear 14. The charging roller 27 rotates at a diameter ratio with respect to the photosensitive drum 26 until the gear portion 32*a* of the separating member 32 meshes with the flange gear 14. In the present embodiment, since the diameter of the photosensitive drum 26 is $\phi$30 mm and the diameter of the charging roller 27 is $\phi$14 mm, the rotation amount of the photosensitive drum 26 is an angle of 25.2 degrees.

Figure 6C:
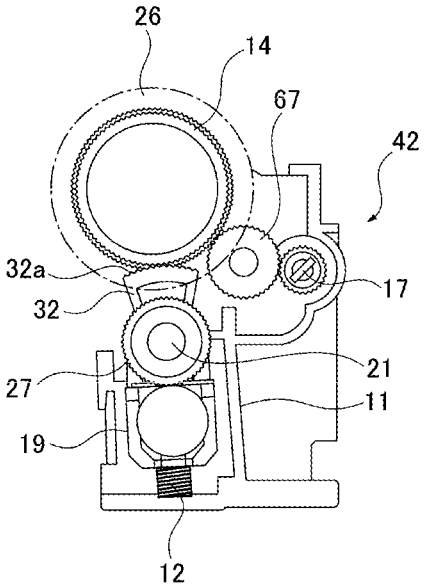

Next, as illustrated in FIG. 6C, when the photosensitive drum 26 and the charging roller 27 continue to rotate in the directions opposite to the rotation directions at the time of image formation, the one-way clutch 21 and the separating member 32 also further rotate. When the separating member 32 further rotates, a force in a direction away from the photosensitive drum 26 acts on the charging roller 27 due to the shape of the separating member 32, and causes the charging roller 27 to be separated from the photosensitive drum 26 against the biasing force of the spring 12. In the present embodiment, when the charging roller 27 further rotates by an angle of 45 degrees after the gear portion 32*a* of the separating member 32 meshes with the flange gear 14, the charging roller 27 is separated from the photosensitive drum 26. After the gear portion 32*a* of the separating member 32 meshes with the flange gear 14, the charging roller 27 rotates at a gear ratio between the gear portion 32*a* of the separating member 32 and the flange gear 14. In the present embodiment, since the separation amount between the photosensitive drum 26 and the charging roller 27 is 1 mm, the rotation amount of the photosensitive drum 26 is an angle of 24 degrees. Note that the charging roller 27 separated from the photosensitive drum 26 performs an operation opposite to the separation operation described above due to the photosensitive drum 26 rotating in the same rotation direction as that at the time of image formation at the time of the next image formation, and comes into contact with the photosensitive drum 26 again.

Figure 6D:
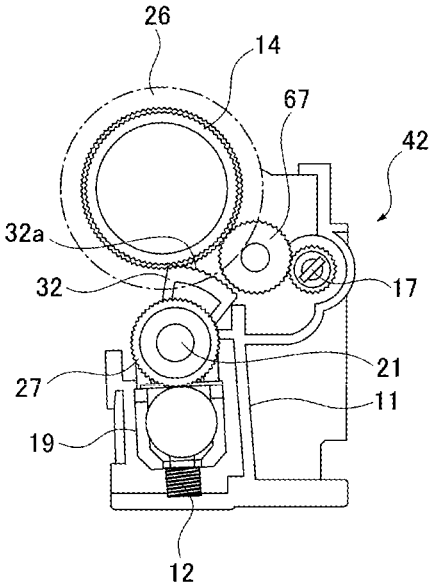

As illustrated in FIG. 6D, when the photosensitive drum 26 is continuously rotated in the direction opposite to the rotation direction at the time of image formation after the charging roller 27 is separated from the photosensitive drum 26, the separating member 32 may come into contact with the drum container 11 to cause a malfunction. In the present embodiment, when the charging roller 27 is further rotated by an angle of 45 degrees (angle of 24 degrees, which is the rotation amount of the photosensitive drum 26) after being separated from the photosensitive drum 26, the separating member 32 and the drum container 11 come into contact with each other. Therefore, in the present embodiment, in order to suppress the contact between the separating member 32 and the drum container 11 while separating the charging roller 27 from the photosensitive drum 26, the rotation amount of the photosensitive drum 26 in the direction opposite to the rotation direction at the time of image formation is set to be in a range from an angle of 49.2 degrees to an angle of 73.2 degrees.

Figure 7:
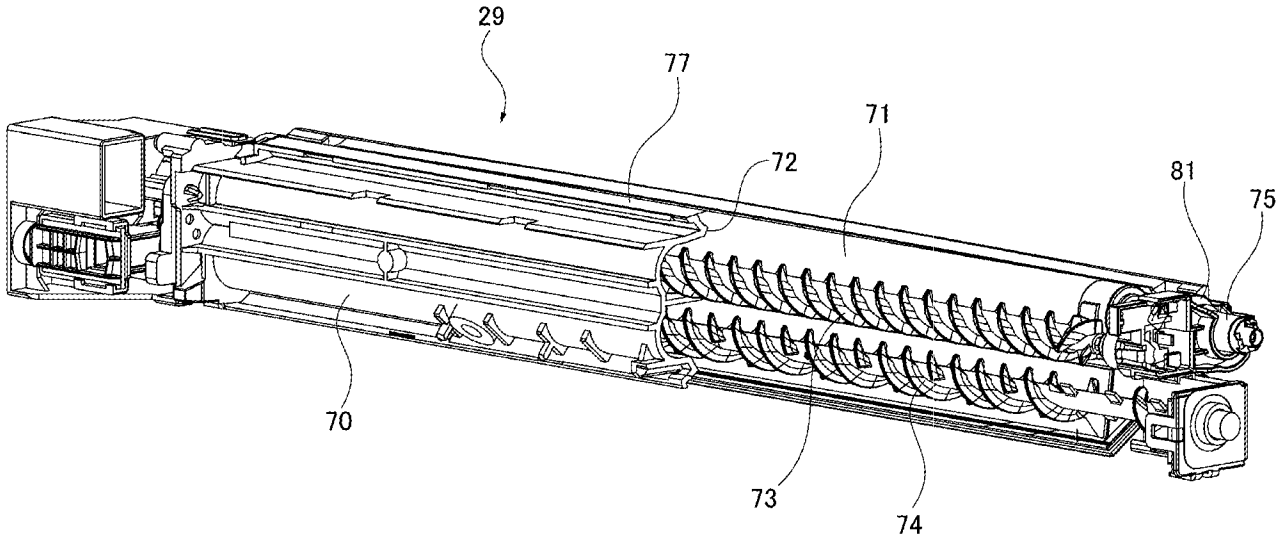
FIG. 7 is a perspective view of a developing unit.

Next, a configuration of the developing unit 29 will be described. FIG. 7 is a perspective view of the developing unit 29. In order to explain the internal configuration of the developing unit 29, FIG. 7 illustrates a cut-out of a part of a developing container 70. As illustrated in FIG. 7, the developing unit 29 includes the developing sleeve 71, a developing blade 72, and conveying screws 73 and 74, and these members are integrally held by the developing container 70.

The developing container 70 has an opening in a portion facing the photosensitive drum 26, and the developing sleeve 71 is disposed so as to be partially exposed to the opening. The developing sleeve 71 is disposed to face the photosensitive drum 26 with a predetermined gap (240 μm in the present embodiment) between the developing sleeve 71 and the photosensitive drum 26. On one end side of the developing sleeve 71 in the rotational axis direction of the developing sleeve 71, a developing coupling 75 that receives a driving force from the drive unit 90 (to be described later) is provided. The developing sleeve 71 rotates by the driving force transmitted from the drive unit 90 via the developing coupling 75.

The developing coupling 75 is held in the developing container 70 at a position on the one end side of the developing sleeve 71 in the rotational axis direction of the developing sleeve 71 in the developing container 70 and on the back side of the image forming apparatus A. An engagement portion (not illustrated) having a D-cut shape to be engaged with the developing coupling 75 is formed on the rotation shaft of the developing sleeve 71, whereby the developing sleeve 71 rotates integrally with the developing coupling 75. A sleeve gear 81 is provided on one end side of the developing sleeve 71 in the developing container 70. The sleeve gear 81 is connected to the rotation shaft of the developing sleeve 71 by a parallel pin (not illustrated), and rotates integrally with the developing sleeve 71.

In addition, the developing sleeve 71 encloses a magnet roller 76 (FIG. 4) having a plurality of magnetic poles in a non-rotating state. As illustrated in FIG. 4, the magnet roller 76 has a developing pole S1 in a developing region present at a position facing the photosensitive drum 26. In addition, the magnet roller 76 has a conveying pole N1, a stripping pole N2, a pumping pole S2, and a cutting pole N3 arranged in this order on the downstream side of the developing pole S1 in the rotation direction of the developing sleeve 71 at the time of image formation. When the center of the developing pole S1 is set to be positioned at an angle of 0 degrees, the center of the conveying pole N1 is positioned at an angle of 60 degrees, the center of the stripping pole N2 is positioned at an angle of 180 degrees, the center of the pumping pole S2 is positioned at an angle of 230 degrees, and the center of the cutting pole N3 is positioned at an angle of 290 degrees, with respect to the rotation direction (counterclockwise direction in FIG. 4) of the developing sleeve 71 at the time of image formation. At the time of image formation, the magnet roller 76 carries toner by the magnetic force of each magnetic pole and conveys the toner to the developing region.

That is, the magnet roller 76 first pumps up the toner stored in the developing container 70 by the pumping pole S2, and causes the developing sleeve 71 to carry the toner. Next, the toner carried on the developing sleeve 71 is napped in a brush shape by the cutting pole N3. Thereafter, the napped toner is conveyed to the developing region by the rotation of the developing sleeve 71, and moved onto the photosensitive drum 26 by the developing pole S1. Thereafter, the toner remaining on the developing sleeve 71 is gradually raised toward the center position between the conveying pole N1 and the stripping pole N2 by a repulsive magnetic field formed by the conveying pole N1 and the stripping pole N2, and is finally stripped from the developing sleeve 71.

In the vicinity of the developing sleeve 71, the developing blade 72 is provided at a predetermined distance from the developing sleeve 71. The developing blade 72 abuts the toner carried on the developing sleeve 71 to form a toner layer having a predetermined thickness. Specifically, as the developing sleeve 71 rotates, the toner carried on the developing sleeve 71 and napped by the cutting pole N3 passes between the tip portion of the developing blade 72 and the surface of the developing sleeve 71, whereby the toner in a regulated amount forms the toner layer. In addition, a scooping sheet 77 that suppresses scattering of toner to the outside of the developing container 70 is attached to the developing blade 72 on the side opposite to the side where the developing sleeve 71 is disposed.

The inside of the developing container 70 is partitioned into a developing chamber 79 and a stirring chamber 80 by a partition wall 78 extending in the rotational axis direction of the developing sleeve 71. Communicating portions (not illustrated) that connect the developing chamber 79 to the stirring chamber 80 are provided at both ends of the partition wall 78 in the longitudinal direction of the partition wall 78.

The developing chamber 79 and the stirring chamber 80 are provided with conveying screws 73 and 74, respectively, which rotate to convey toner by spiral blades. The conveying screws 73 and 74 convey toner in directions opposite to each other in the longitudinal direction of the partition wall 78. The conveying screws 73 and 74 rotate when a driving force is transmitted from the sleeve gear 81 provided integrally with the developing sleeve 71. When the conveying screws 73 and 74 rotate, toner circulates between the developing chamber 79 and the stirring chamber 80 via the communicating portions (not illustrated).

Further, every time the image forming operation is performed, toner is deposited in a space surrounded by the developing sleeve 71, the developing blade 72, and the scooping sheet 77 in the developing container 70. In a case where the amount of the deposited toner is excessive, there is a possibility that the deposited toner may enter the developing region and cause a defective image called a spot image. In order to avoid this, the developing sleeve 71 rotates in a direction opposite to the rotation direction at the time of image formation at the time of non-image formation after the image forming operation is performed a predetermined number of times, and moves the toner accumulated in the space surrounded by the developing sleeve 71, the scooping sheet 77, and the developing blade 72 to the stirring chamber 80 side. Specifically, the toner raised by the repulsive magnetic field formed by the conveying pole N1 and the stripping pole N2 passes through the space surrounded by the developing sleeve 71, the scooping sheet 77, and the developing blade 72 by the rotation of the developing sleeve 71, and the toner deposited in this space is pushed back to the stirring chamber 80 side. In the present embodiment, every time 500 sheets of A4 size are subjected to the image forming operation, the developing sleeve 71 is rotated in the opposite direction.

In a case where the rotation amount of the developing sleeve 71 in the direction opposite to the rotation direction at the time of image formation is large, a large amount of toner is conveyed to the developing region without the toner pumped by the pumping pole S2 passing through the developing blade 72. As a result, the toner may scatter to the outside of the developing container 70. Therefore, in order to suppress the scattering of the toner to the outside, the rotation amount of the developing sleeve 71 in the direction opposite to the rotation direction at the time of image formation is set to an angle from the conveying pole N1 to the stripping pole N2. That is, in the present embodiment, the angle around the rotational axis of the developing sleeve 71 is set to an angle from 60 degrees to 180 degrees.

<Drive Unit>

Next, a configuration of the drive unit 90 that drives the process cartridge 65 will be described.

Figure 8A:
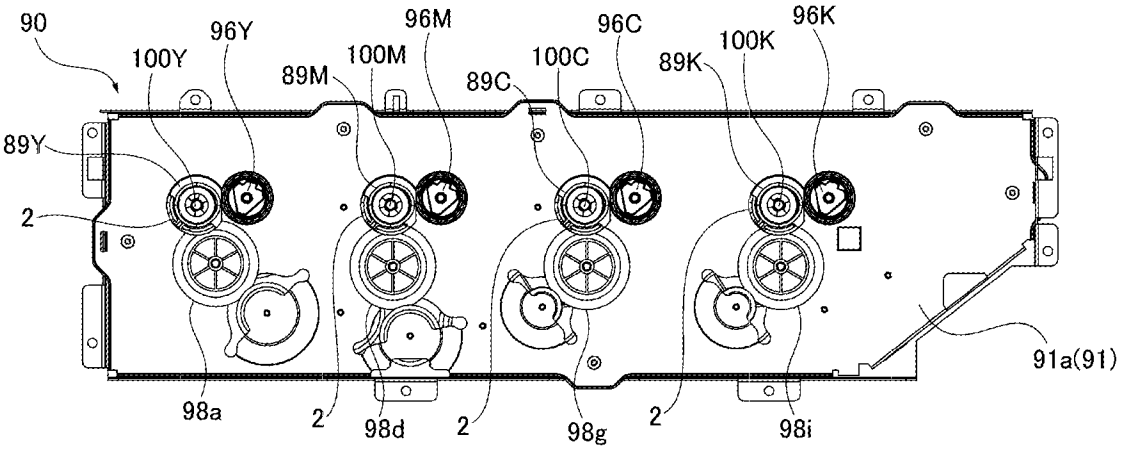
FIGS. 8A and 8B are a front view and a rear view of a drive unit.
Figure 8B:
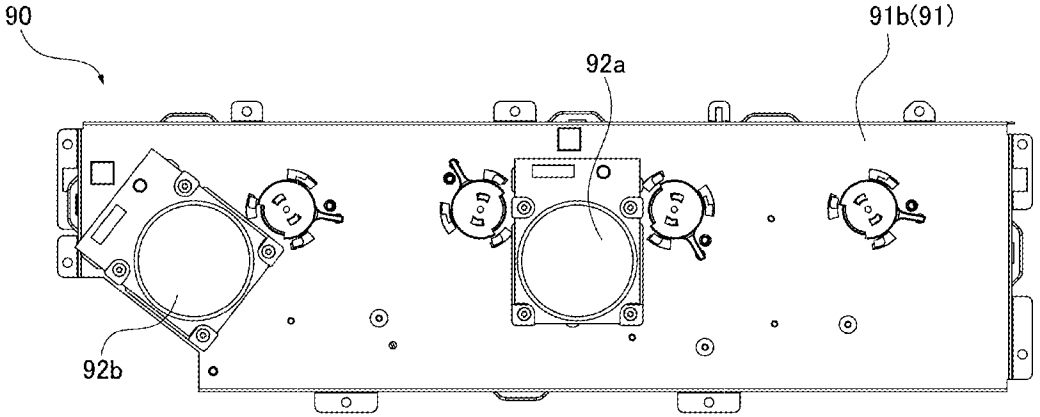
Figure 9:
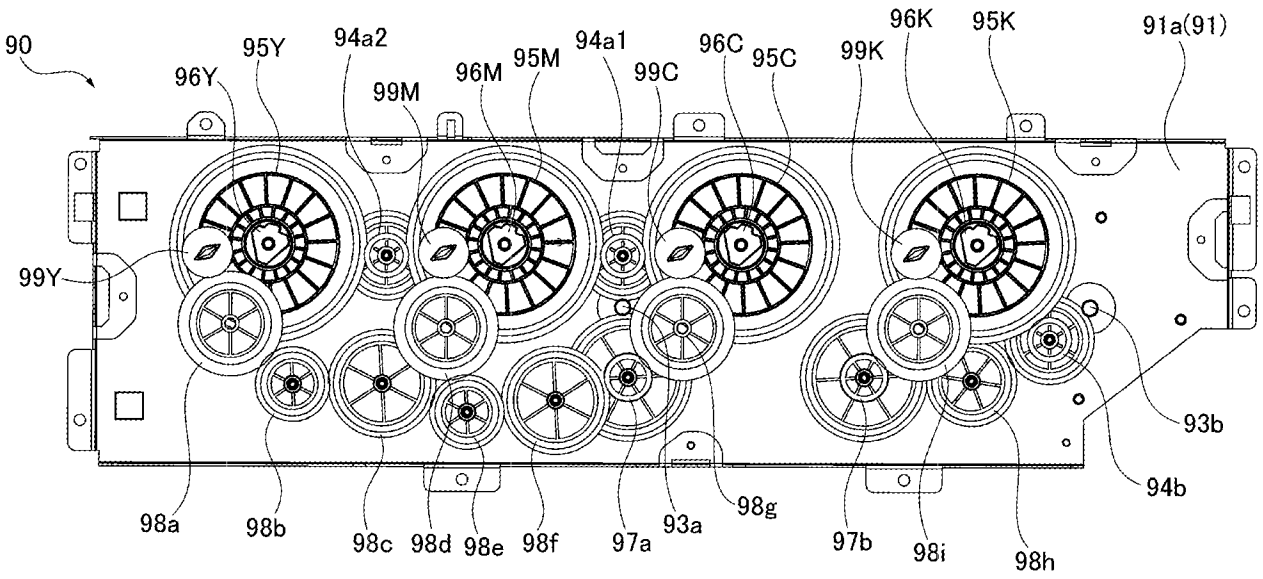
FIG. 9 is a diagram illustrating gears of the drive unit.

FIG. 8A is a front view of the drive unit 90. FIG. 8B is a rear view of the drive unit 90. FIG. 9 is a diagram illustrating gears included in the drive unit 90. As illustrated in FIGS. 8A, 8B, and 9, the drive unit 90 includes a box-shaped drive frame 91 including a rear frame 91*a* and a front frame 91*b*.

The motor 92*a* serving as the drive source for driving the photosensitive drums 26Y, 26M, and 26C and the developing sleeves 71Y, 71M, and 71C, and the motor 92*b* serving as the drive source for driving the photosensitive drum 26K and the developing sleeve 71K are fixed to the drive frame 91. In the present embodiment, the motors 92*a* and 92*b* are DC brushless motors.

A pinion gear 93*a* is attached to a shaft of the motor 92*a*. A drum reduction gear 94*a*1 meshes with the pinion gear 93*a*, and drum drive gears 95M and 95C mesh with the drum reduction gear 94*a*1. A drum reduction gear 94*a*2 meshes with the drum drive gear 95M and a drum drive gear 95Y. Due to the gear ratios of these gear trains, the rotation speeds of the drum drive gears 95Y, 95M, and 95C are reduced with respect to the rotation speed of the motor 92*a*.

A pinion gear 93*b* is attached to a shaft of the motor 92*b*. A drum reduction gear 94*b* meshes with the pinion gear 93*b*, and a drum drive gear 95K meshes with the drum reduction gear 94*b*. Due to the gear ratios of these gear trains, the rotation speed of the drum drive gear 95K is reduced with respect to the rotation speed of the motor 92*b*.

Figure 10A:
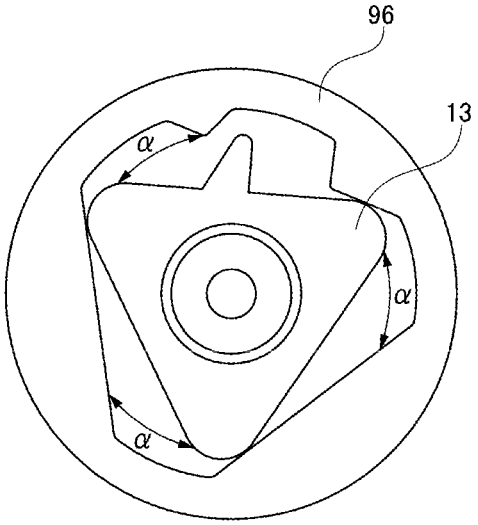
FIGS. 10A and 10B are diagrams illustrating configurations of a drive coupling, a drum coupling, and a developing coupling.

Drive couplings 96Y, 96M, 96C, and 96K that engage with drum couplings 13 provided in the process cartridges 65Y, 65M, 65C, and 65K are arranged coaxially with the drum drive gears 95Y, 95M, 95C, and 95K, respectively. In this case, as illustrated in FIG. 10A, play α in a rotation direction is provided between the drive coupling 96 and the drum coupling 13 of each color. In the present embodiment, the play α is set to an angle of 34 degrees, which is an angle around the rotational axis of the photosensitive drum 26.

With such a configuration, the driving force of the motor 92*a* is transmitted to the drum couplings 13 via the pinion gear 93*a*, the drum reduction gears 94*a*1 and 94*a*2, the drum drive gears 95Y, 95M, and 95C, and the drive couplings 96Y, 96M, and 96C. As a result, the photosensitive drums 26Y, 26M, and 26C rotate. That is, the pinion gear 93*a*, the drum reduction gears 94*a*1 and 94*a*2, the drum drive gears 95Y, 95M, and 95C, the drive couplings 96Y, 96M, and 96C, and the drum couplings 13 form drive trains that transmit a driving force between the motor 92*a* and the photosensitive drums 26Y, 26M, and 26C. The drive couplings 96Y, 96M, and 96C and the drum couplings 13 are couplings that are interposed in the drive trains between the motor 92*a* and the photosensitive drums 26Y, 26M, and 26C and have the play in the rotation directions.

The driving force of the motor 92*b* is transmitted to the drum coupling 13 via the pinion gear 93*b*, the drum reduction gear 94*b*, the drum drive gear 95K, and the drive coupling 96K, whereby the photosensitive drum 26K rotates. That is, the pinion gear 93*b*, the drum reduction gear 94*b*, the drum drive gear 95K, the drive coupling 96K, and the drum coupling 13 form a drive train that transmits a driving force between the motor 92*b* and the photosensitive drum 26K. The drive coupling 96K and the drum coupling 13 are couplings that are interposed in the drive train between the motor 92*b* and the photosensitive drum 26K and have the play in the rotation direction.

A developing reduction gear 97*a* meshes with the pinion gear 93*a*. A plurality of idler gears 98*a* to 98*g* is provided so as to form a gear train with the developing reduction gear 97*a*. The idler gears 98*a*, 98*d*, and 98*g* mesh with developing drive gears 99Y, 99M, and 99C, respectively. Due to the gear ratios of these gear trains, the rotation speeds of the developing sleeves 71Y, 71M, and 71C are reduced with respect to the rotation speed of the motor 92*a* so as to be 198% of the rotation speeds of the photosensitive drums 26Y, 26M, and 26C.

The pinion gear 93*b* meshes with a developing drive gear 99K via a gear train formed by the drum reduction gear 94*b*, an idler gear 98*h*, a developing reduction gear 97*b*, and an idler gear 98*i*. Due to the gear ratios of these gear trains, the rotation speed of the developing sleeve 71K is reduced with respect to the rotation speed of the motor 92*b* so as to be 198% of the rotation speed of the photosensitive drum 26K.

Figure 10B:
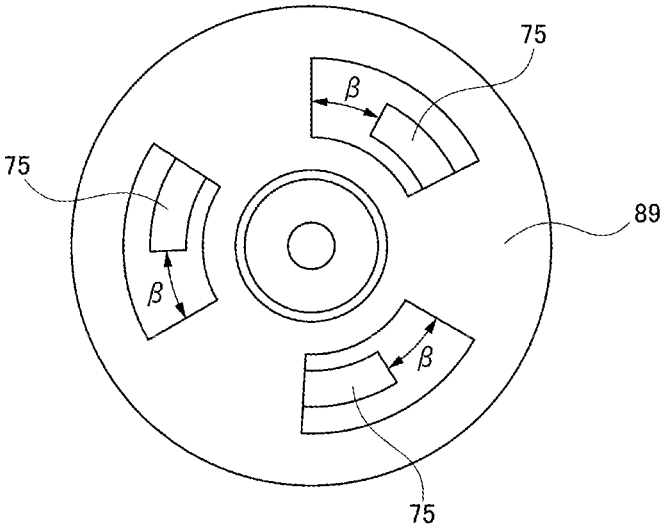

Further, rotation shafts (not illustrated) of the developing drive gears 99Y, 99M, 99C, and 99K are connected to rotation shafts 100Y, 100M, 100C, and 100K of developing couplings 75 provided in the process cartridges 65Y, 65M, 65C, and 65K illustrated in FIG. 8A by Oldham couplings 1 (to be described later). Further, in the developing couplings 75, drive couplings 89Y, 89M, 89C, and 89K that engage with the developing couplings 75 provided in the process cartridges 65Y, 65M, 65C, and 65K engage with the rotation shafts 100Y, 100M, 100C, and 100K that form parts of the Oldham couplings 1. In this case, as illustrated in FIG. 10B, play in a rotation direction is provided between the drive coupling 89 and the developing coupling 75 of each color. In the present embodiment, the play β is set to an angle of 30 degrees, which is the angle around the rotational axis of the developing sleeve 71.

With such a configuration, the driving force of the motor 92*a* is transmitted to the developing couplings 75 via the pinion gear 93*a*, the developing reduction gear 97*a*, the idler gears 98*a* to 98*g*, the developing drive gears 99Y, 99M, and 99C, and the drive couplings 89Y, 89M, and 89C. As a result, the developing sleeves 71Y, 71M, and 71C rotate. That is, the pinion gear 93*a*, the developing reduction gear 97*a*, the idler gears 98*a* to 98*g*, the developing drive gears 99Y, 99M, and 99C, the drive couplings 89Y, 89M, and 89C, and the developing couplings 75 form drive trains that transmit a driving force between the motor 92*a* and the developing sleeves 71Y, 71M, and 71C. The drive couplings 96Y, 96M, and 96C, the drum couplings 13, and the Oldham couplings 1 are couplings that are interposed in the drive trains between the motor 92*a* and the developing sleeves 71Y, 71M, and 71C and have the play in the rotation direction.

The driving force of the motor 92*b* is transmitted to the developing coupling 75 via the pinion gear 93*b*, the developing reduction gear 97*a*, the idler gears 98*h* and 98*i*, the developing drive gear 99K, and the drive coupling 89K. As a result, the developing sleeve 71K rotates. That is, the pinion gear 93*b*, the developing reduction gear 97*a*, the idler gears 98*h* and 98*i*, the developing drive gear 99K, the drive coupling 89K, and the developing coupling 75 form a drive train that transmits a driving force between the motor 92*b* and the developing sleeve 71K. The drive coupling 96K, the drum coupling 13, and the Oldham coupling 1 are couplings that are interposed in the drive train between the motor 92*b* and the developing sleeve 71K and have the play in the rotation direction.

As described above, in the present embodiment, the rotation speed of the developing sleeve 71 of each color is 198% of the rotation speed of the photosensitive drum 26 of each color. In the present embodiment, the diameter of the photosensitive drum 26 is ϕ30 mm, and the diameter of the developing sleeve 71 is ϕ18 mm. Therefore, the difference in gear ratio between the photosensitive drum 26 and the developing sleeve 71 is about 3.3 times. That is, when the photosensitive drum 26 makes one turn, the developing sleeve 71 makes about 3.3 turns.

<Oldham Coupling>

Next, a configuration of the Oldham coupling 1 will be described.

Figure 11:
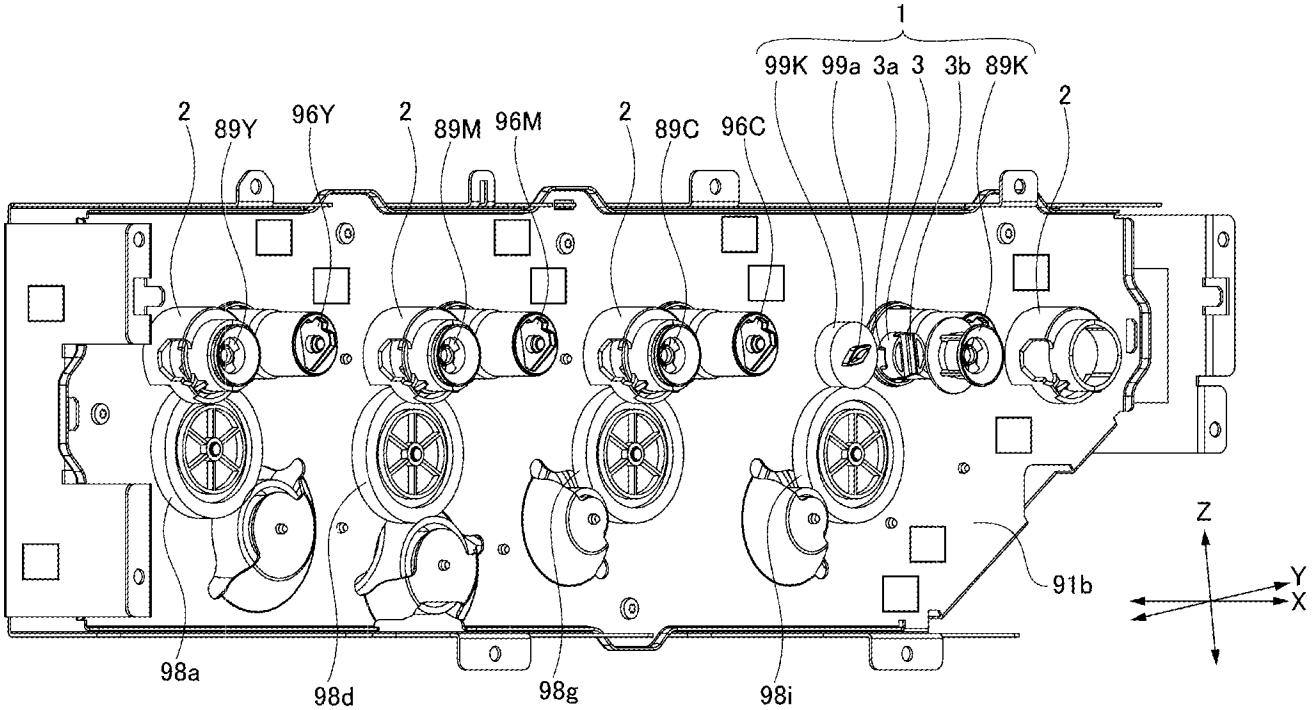
FIG. 11 is an exploded perspective view of an Oldham coupling.
Figure 12:
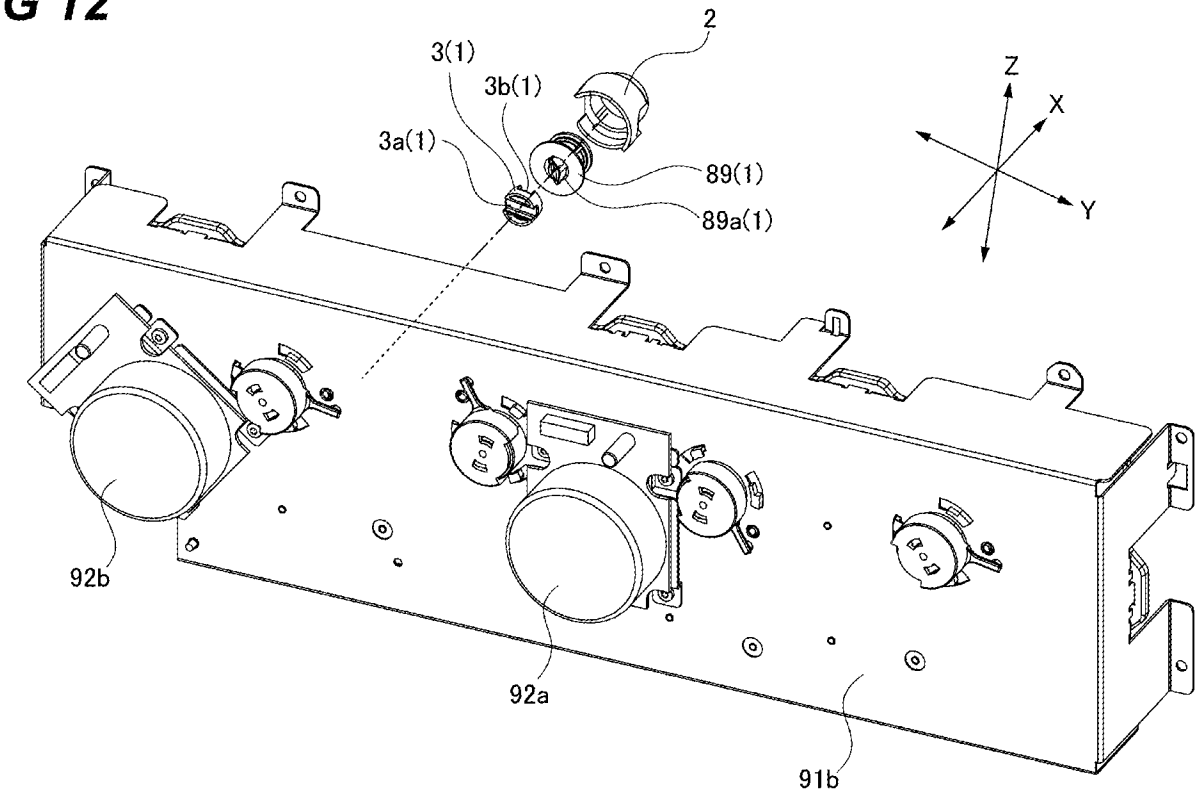
FIG. 12 is an exploded perspective view of the Oldham coupling.
Figure 13A:
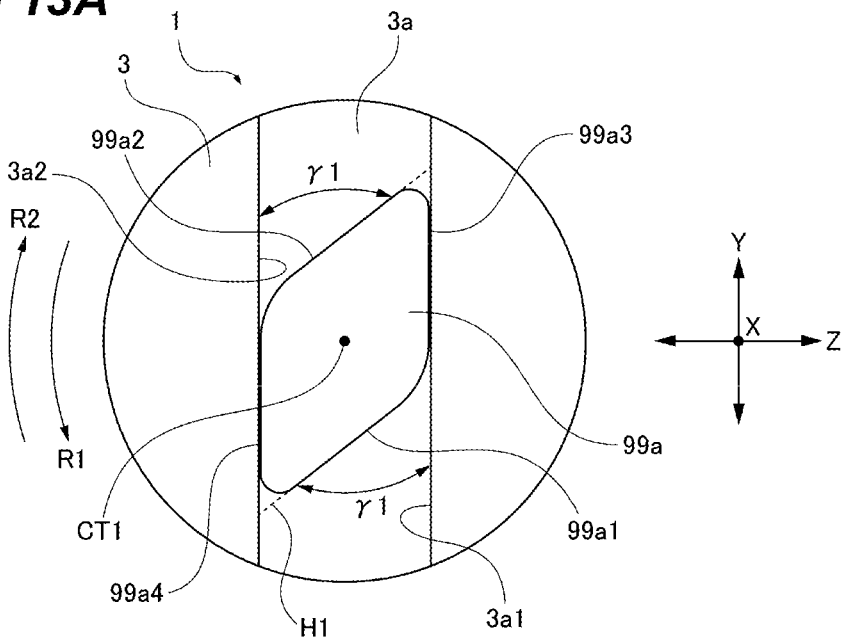
FIGS. 13A and 13B are diagrams illustrating a fitting portion of the Oldham coupling between a developing drive gear and an intermediate member and a fitting portion of the Oldham coupling between the drive coupling and the intermediate member.
Figure 13B:
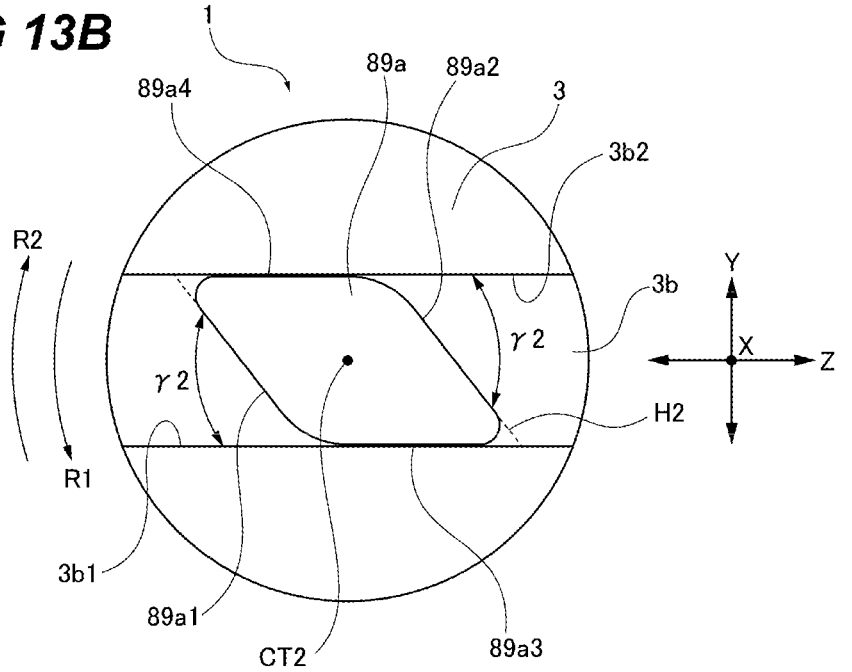

FIG. 11 is an exploded perspective view of the Oldham coupling 1 as viewed from the front side of the image forming apparatus A. FIG. 12 is an exploded perspective view of the Oldham coupling 1 as viewed from the back side of the image forming apparatus A. FIG. 13A is a diagram illustrating a fitting portion between the developing drive gear 99 of the Oldham coupling 1 and an intermediate member 3. FIG. 13B is a diagram illustrating a fitting portion between the drive coupling 89 of the Oldham coupling 1 and the intermediate member 3.

As illustrated in FIGS. 11 and 12, the Oldham coupling 1 includes the developing drive gear 99 (first hub), the drive coupling 89 (second hub), and the intermediate member 3 that transmits a driving force between the developing drive gear 99 and the drive coupling 89. The Oldham coupling 1 is rotatably held inside a coupling holder 2 provided in the front frame 91*b*.

In an arrow X direction which is a rotational axis direction of the Oldham coupling 1, a recess 3*a* (first recess) having a rectangular cross section recessed in the arrow X direction and extending in an arrow Y direction (first direction) orthogonal to the arrow X direction is formed in one end surface of the intermediate member 3. In the arrow X direction, a recess 3*b* (second recess) having a rectangular cross section recessed in the arrow X direction and extending in an arrow Z direction (second direction) orthogonal to the arrow X direction and the arrow Y direction is formed in the other end surface of the intermediate member 3. The shapes of the recesses 3*a* and 3*b* are the same except that the recesses 3*a* and 3*b* extend in the directions orthogonal to each other. Note that the rotational axis direction of the Oldham coupling 1 is the same direction as the rotational axis direction of the developing drive gear 99, the rotational axis direction of the drive coupling 89, and the rotational axis direction of the intermediate member 3.

In addition, in the rotational axis direction (arrow X direction) of the Oldham coupling 1, a protrusion 99*a* (first protrusion) protruding in the arrow X direction and fitted in the recess 3*a* of the intermediate member 3 is formed at one end portion of the developing drive gear 99. In the rotational axis direction of the Oldham coupling 1, a protrusion 89*a* (second protrusion) protruding in the arrow X direction and fitted in the recess 3*b* of the intermediate member 3 is formed at one end portion of the drive coupling 89.

When the developing drive gear 99 rotates by the driving force of the motor 92*a* or 92*b*, the protrusion 99*a* of the developing drive gear 99 comes into contact with the inner wall of the recess 3*a* while relatively sliding and moving inside the recess 3*a* to transmit a driving force to the intermediate member 3, and the intermediate member 3 rotates. When the intermediate member 3 rotates, while the protrusion 89*a* of the drive coupling 89 relatively slides inside the recess 3*b*, the inner wall of the recess 3*a* comes into contact with the protrusion 89*a* to transmit a driving force to the drive coupling 89, and the drive coupling 89 rotates. In this manner, even in a case where the rotational axis of the rotation shaft (not illustrated) of the developing drive gear 99 and the rotational axis of the rotation shaft 100 of the developing coupling 75 are misaligned, the driving force of the motor 92*a* or 92*b* is stably transmitted to the rotation shaft 100 of the developing coupling 75 via the Oldham coupling 1.

In this case, as illustrated in FIG. 13A, the protrusion 99*a* has an edge 99*a*1 (first edge) that comes into contact with one inner wall 3*a*1 (first inner wall) of the recess 3*a* in the width direction of the recess 3*a* when the Oldham coupling 1 rotates in an arrow R1 direction. The protrusion 99*a* has an edge 99*a*2 (second edge) that comes into contact with another inner wall 3*a*2 (second inner wall) of the recess 3*a* in the width direction of the recess 3*a* when the Oldham coupling 1 rotates in the arrow R1 direction. The protrusion 99*a* has an edge 99*a*3 (third edge) that comes into contact with the inner wall 3*a*1 of the recess 3*a* when the Oldham coupling 1 rotates in an arrow R2 direction, and an edge 99*a*4 (fourth edge) that comes into contact with the inner wall 3*a*2 when the Oldham coupling 1 rotates in the arrow R2 direction. Each of the edges 99*a*1 to 99*a*4 comes into surface contact with the inner wall 3*a*1 or the inner wall 3*a*2 of the recess 3*a* via a surface extending in the arrow Y direction and the arrow X direction. The width direction of the recess 3*a* is the arrow Z direction that is orthogonal to the arrow Y direction in which the recess 3*a* extends, and is the same direction as the direction in which the recess 3*b* extends. The arrow R1 direction is the rotation direction of Oldham coupling 1 when the motors 92*a* and 92*b* rotate in a rotation direction at the time of image formation, and the arrow R2 direction is a rotation direction opposite to the arrow R1 direction.

In this case, when the Oldham coupling 1 rotates in the arrow R2 direction, a portion of the edge 99*a*1 farthest from a rotation center CT1 (first rotational center) of the developing drive gear 99 in the arrow Y direction is positioned closer to the inner wall 3a2 than to the rotation center CT1 in the arrow Z direction. When the Oldham coupling 1 rotates in the arrow R2 direction, a portion of the edge 99a2 farthest from the rotation center CT1 in the arrow Y direction is positioned closer to the inner wall 3a1 than to the rotation center CT1 in the arrow Z direction. When the Oldham coupling 1 rotates in the arrow R1 direction, a portion of the edge 99a3 farthest from the rotation center CT1 in the arrow Y direction is positioned closer to the inner wall 3a2 than to the rotation center CT1 in the arrow Z direction. When the Oldham coupling 1 rotates in the arrow R1 direction, a portion of the edge 99a4 farthest from the rotation center CT1 in the arrow Y direction is positioned closer to the inner wall 3a1 than to the rotation center CT1 in the arrow Z direction.

In addition, the protrusion 99a has a shape in which a substantially rhombus is formed by an imaginary line H1 connecting the edge 99a1, the edge 99a2, the edge 99a3, and the edge 99a4 as viewed from the rotational axis direction (arrow X direction) of the Oldham coupling 1. Specifically, the rhombus is formed in which the angle of a corner portion formed by an imaginary line obtained by extending the edge 99a1 and the edge 99a4 is 45 degrees, and the angle of a corner portion formed by an imaginary line obtained by extending the edge 99a2 and the edge 99a3 is 45 degrees. The substantially rhombic shape may have the corner portions as described above or may be a shape in which the corner portions as described above are chamfered.

With such a configuration, when the Oldham coupling 1 rotates in the arrow R2 direction, play γ1 is provided between the edge 99a1 and the inner wall 3a1 of the recess 3a and between the edge 99a2 and the inner wall 3a2 of the recess 3a. When the Oldham coupling 1 rotates in the arrow R1 direction, similar play γ1 is provided between the edge 99a3 and the inner wall 3a1 of the recess 3a and between the edge 99a4 and the inner wall 3a2 of the recess 3a.

As illustrated in FIG. 13B, the protrusion 89a has the same shape as the protrusion 99a. That is, the protrusion 89a has an edge 89a1 (fifth edge) that comes into contact with one inner wall 3b1 (third inner wall) of the recess 3b in the width direction of the recess 3b when the Oldham coupling 1 rotates in the arrow R1 direction. The protrusion 89a has an edge 89a2 (sixth edge) that comes into contact with the other inner wall 3b2 (fourth inner wall) of the recess 3b in the width direction of the recess 3b when the Oldham coupling 1 rotates in the arrow R1 direction. The protrusion 89a has an edge 89a3 (seventh edge) that comes into contact with the inner wall 3b1 of the recess 3b when the Oldham coupling 1 rotates in the arrow R2 direction, and an edge 89a4 (eighth edge) that comes into contact with the inner wall 3b2 when the Oldham coupling 1 rotates in the arrow R2 direction. Each of the edges 89a1 to 89a4 comes into surface contact with the inner wall 3b1 or the inner wall 3b2 of the recess 3b via a surface extending in the arrow Z direction and the arrow X direction. The width direction of the recess 3b is the arrow Y direction that is orthogonal to the arrow Z direction in which the recess 3b extends, and is the same direction as the direction in which the recess 3a extends.

In this case, when the Oldham coupling 1 rotates in the arrow R2 direction, a portion of the edge 89a1 farthest from a rotation center CT2 (second rotation center) of the drive coupling 89 in the arrow Z direction is positioned closer to the inner wall 3b2 than to the rotation center CT2 in the arrow Y direction. When the Oldham coupling 1 rotates in the arrow R2 direction, a portion of the edge 89a2 farthest from the rotation center CT2 in the arrow Z direction is positioned closer to the inner wall 3b1 than to the rotation center CT2 in the arrow Y direction. When the Oldham coupling 1 rotates in the arrow R1 direction, a portion of the edge 89a3 farthest from the rotation center CT2 in the arrow Z direction is positioned closer to the inner wall 3b2 than to the rotation center CT2 in the arrow Y direction. When the Oldham coupling 1 rotates in the arrow R1 direction, a portion of the edge 89a4 farthest from the rotation center CT2 in the arrow Z direction is positioned closer to the inner wall 3b1 than to the rotation center CT2 in the arrow Y direction.

The protrusion 89a has a shape in which a substantially rhombus is formed by an imaginary line H2 connecting the edge 89a1, the edge 89a2, the edge 89a3, and the edge 89a4 as viewed from the rotational axis direction of the Oldham coupling 1. Specifically, the rhombus is formed in which the angle of a corner portion formed by an imaginary line obtained by extending the edge 89a1 and the edge 89a4 is 45 degrees, and the angle of a corner portion formed by an imaginary line obtained by extending the edge 89a2 and the edge 89a3 is 45 degrees. Note that the substantially rhombic shape may have the corner portions as described above or may be a shape in which the corner portions as described above are chamfered as in the present embodiment.

With such a configuration, when the Oldham coupling 1 rotates in the arrow R2 direction, play γ2 is provided between the edge 89a1 and the inner wall 3b1 of the recess 3b and between the edge 89a2 and the inner wall 3b2 of the recess 3b. When the Oldham coupling 1 rotates in the arrow R1 direction, similar play γ2 is provided between the edge 89a3 and the inner wall 3b1 of the recess 3b and between the edge 89a4 and the inner wall 3b2 of the recess 3b.

As described above, according to the configuration of the present embodiment, in the Oldham coupling 1, the driving force can be transmitted while the play γ1 in the rotation direction is provided between the developing drive gear 99 and the intermediate member 3 and the play γ2 in the rotation direction is provided between the drive coupling 89 and the intermediate member 3. In addition, since each of the edges 99a1 to 99a4 comes into surface contact with the inner wall 3a1 or the inner wall 3a2 of the recess 3a and each of the edges 89a1 to 89a4 comes into surface contact with the inner wall 3b1 or the inner wall 3b2 of the recess 3b, it is possible to secure the strength of the protrusions 99a and 89a at the time of transmitting the driving force and to suppress deformation.

<Operation Timing During Reverse Rotation of Motor>

Next, an operation timing when the photosensitive drum 26, the developing sleeve 71, and the charging roller 27 rotate in the directions opposite to the rotation directions at the time of image formation will be described.

Figure 14:
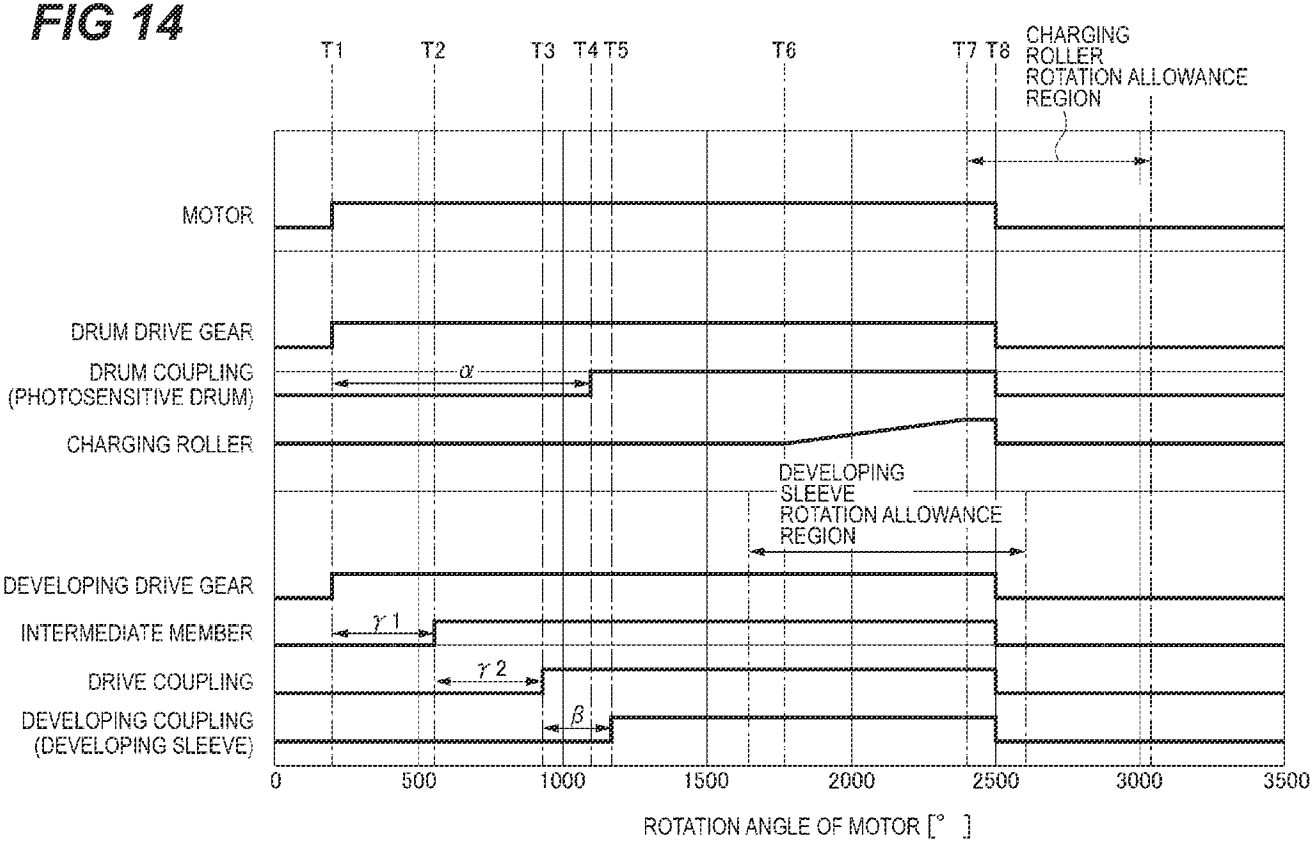
FIG. 14 is a timing chart illustrating an ideal operation timing of each member after the end of an image forming operation.

FIG. 14 is a timing chart illustrating ideal operation timings when the photosensitive drum 26, the developing sleeve 71, and the charging roller 27 rotate in the directions opposite to the rotation directions at the time of image formation.

As illustrated in FIG. 14, when the image forming operation is first ended, these members are stopped in a state in which the play α between the drive coupling 96 and the drum coupling 13, the play β between the drive coupling 89 and the developing coupling 75, and the play γ1 and γ2 of the Oldham coupling 1 are secured. In this state, the motors 92a and 92b start rotational driving in a direction opposite to the rotation direction at the time of image formation.

When the motors 92*a* and 92*b* start to rotate, the drum drive gear 95 and the developing drive gear 99 start to rotate (at time T1).

Next, when time T2 is reached, the play γ1 of the Oldham coupling 1 is reduced by the rotation of the developing drive gear 99, and the intermediate member 3 starts to rotate. Thereafter, when time T3 is reached, the play γ2 of the Oldham coupling 1 is reduced by the rotation of the intermediate member 3, and the drive coupling 89 starts to rotate.

Next, when time T4 is reached, the play a is reduced by the rotation of the drum drive gear 95, the drum coupling 13 starts to rotate, and accordingly, the photosensitive drum 26 starts to rotate.

Thereafter, when time T5 is reached, the play β is reduced by the rotation of the drive coupling 89, the developing coupling 75 starts to rotate, and accordingly, the developing sleeve 71 starts to rotate.

Next, when time T6 is reached, the gear portion 32*a* of the separating member 32 meshes with the flange gear 14 in accordance with the rotation of the photosensitive drum 26, and the charging roller 27 starts to be separated from the photosensitive drum 26. When time T7 is reached, the charging roller 27 is separated to a predetermined position, and the separation is completed. Thereafter, when time T8 is reached, the developing sleeve 71 rotates by up to a predetermined rotation angle, and the driving of the motors 92*a* and 92*b* is stopped.

In this case, after the driving of the motors 92*a* and 92*b* is stopped, a rotating member constituting the drive train that transmits the driving force to the photosensitive drum 26 and a rotating member constituting the drive train that transmits the driving force to the developing sleeve 71 rotate by inertia. In particular, a stop load is applied to the drive train that transmits the driving force to the photosensitive drum 26 by a frictional force between the photosensitive drum 26 and the cleaning blade 45. However, since such a stop load is not applied to the drive train that transmits the driving force to the developing sleeve 71, the rotation amounts tend to be large. Due to the rotation by the inertia, the play α, β, γ1, and γ2 in the rotation direction of each coupling described above after the driving of the motors 92*a* and 92*b* is stopped becomes smaller than ideal sizes.

Figure 15A:
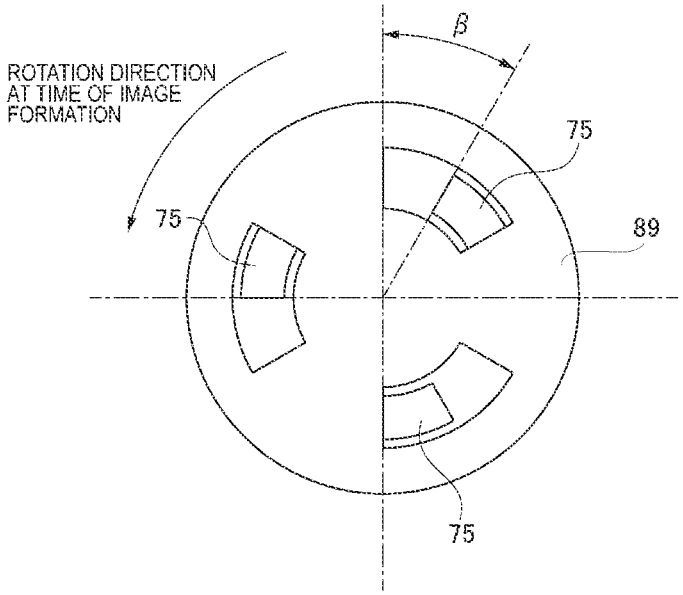
FIGS. 15A and 15B are diagrams illustrating positional relationships between the developing coupling and the drive coupling.
Figure 15B:
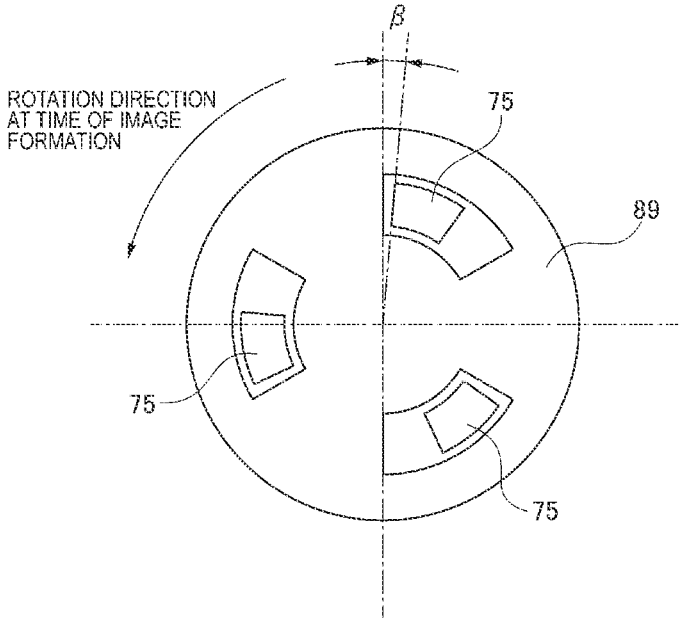

FIGS. 15A and 15B are diagrams illustrating positional relationships between the developing coupling 75 and the drive coupling 89 when the driving of the motors 92*a* and 92*b* is stopped after the end of the image forming operation. FIG. 15A illustrates an ideal positional relationship between the developing coupling 75 and the drive coupling 89 without consideration of inertia. FIG. 15B illustrates a positional relationship between the developing coupling 75 and the drive coupling 89 in consideration of inertia.

As illustrated in FIG. 15A, in the case where inertia is not considered, when the driving of the motors 92*a* and 92*b* is stopped, the positional relationship between the developing coupling 75 and the drive coupling 89 is a backlash-reduced state in the rotation direction at the time of image formation. In this case, the play γ of both couplings in the direction opposite to the rotation direction at the time of image formation is the maximum value. On the other hand, as illustrated in FIG. 15B, in the case where inertia is considered, the positional relationship between the developing coupling 75 and the drive coupling 89 has backlash in the rotation direction at the time of image formation. In this case, the play γ of both couplings in the direction opposite to the rotation direction at the time of image formation is smaller than the ideal value (maximum value). As described above, due to the effect of the rotation of the developing coupling 75 and the drive coupling 89 by inertia, the play γ in the rotation direction of both couplings is smaller than the ideal value (maximum value). In the present embodiment, the play γ illustrated in FIG. 15A is an angle of 30 degrees, and the play γ illustrated in FIG. 15B is an angle of 2 degrees reduced by 28 degrees from the ideal value (maximum value). Similarly, the play α between the drive coupling 96 and the drum coupling 13 and the play γ1, γ2 of the Oldham coupling 1 are also smaller than the ideal values.

In the present embodiment, the rotation angle of the photosensitive drum 26 in the direction opposite to the rotation direction at the time of image formation is in a range from 49.2 degrees to 73.2 degrees, which is necessary to separate the charging roller 27 from the photosensitive drum 26. Also, the play a between the drive coupling 96 and the drum coupling 13 is an angle of 34 degrees. Therefore, in order to separate the charging roller 27 from the photosensitive drum 26, it is necessary to rotate the photosensitive drum 26 by an angle of 83.2 degrees obtained by adding 34 degrees, which is the play α, to 49.2 degrees, which is the rotation amount of the photosensitive drum 26 and is required to separate the charging roller 27 from the photosensitive drum 26.

As described above, since the reduction ratio between the drive train that drives the photosensitive drum 26 and the drive train that drives the developing sleeve 71 is 3.3 times, when the photosensitive drum 26 is rotated by an angle of 83.2 degrees, the developing sleeve 71 is rotated by an angle of about 274.6 degrees. Since the play of each coupling in the drive train that drives the developing sleeve 71 is an angle of 120 degrees (β+γ1+γ2), when the photosensitive drum 26 is rotated by an angle of 83.2 degrees, the ideal value of the rotation amount of the developing sleeve 71 is an angle of about 154.6 degrees.

However, as illustrated in FIG. 15B, when the rotation in the direction opposite to the rotation direction at the time of image formation starts with the play β reduced by an angle of 28 degrees from the ideal value, the developing sleeve 71 is rotated by an angle of 182.6 degrees (154.6 degrees+28 degrees). In this case, since the allowable rotation angle of the developing sleeve 71 is in a range from 60 degrees to 180 degrees, the rotation angle of the developing sleeve 71 exceeds the allowable rotation angle of the developing sleeve 71, and the toner may scatter from the developing container 70. That is, since the play α, β, γ1, and γ2 varies from the ideal values due to the rotation by inertia, the operation timing of each member is shifted, and thus, the accuracy of the control for switching the motors 92*a* and 92*b* from the forward rotation which is the rotation in the rotation direction at the time of image formation to the reverse rotation opposite to the forward rotation deteriorates.

<Reverse Rotation Sequence>

In the present embodiment, when the motors 92*a* and 92*b* are switched from the forward rotation to the reverse rotation in a reverse rotation sequence performed after the end of the image forming operation, the deterioration in the accuracy of the control at the time of the reverse rotation described above is suppressed. Hereinafter, the reverse rotation sequence will be described with reference to a flowchart illustrated in FIGS. 16A and 16B.

Figure 16A:
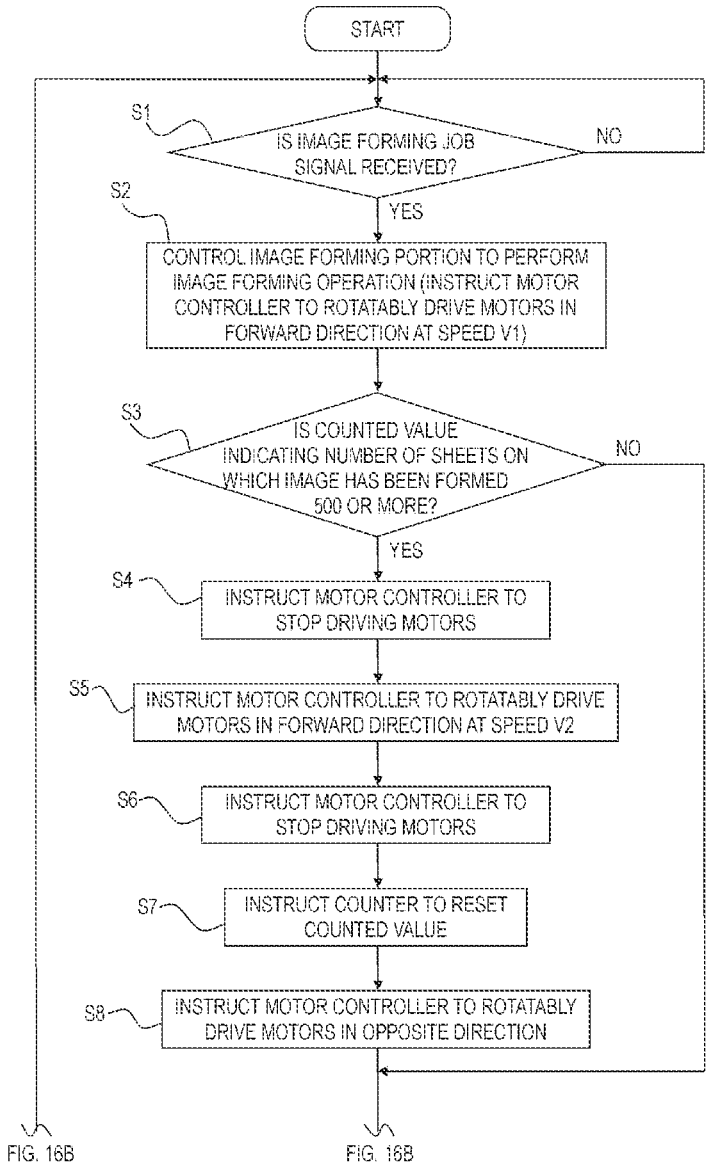
FIGS. 16A and 16B are flowcharts of a reverse rotation sequence.
Figure 16B:
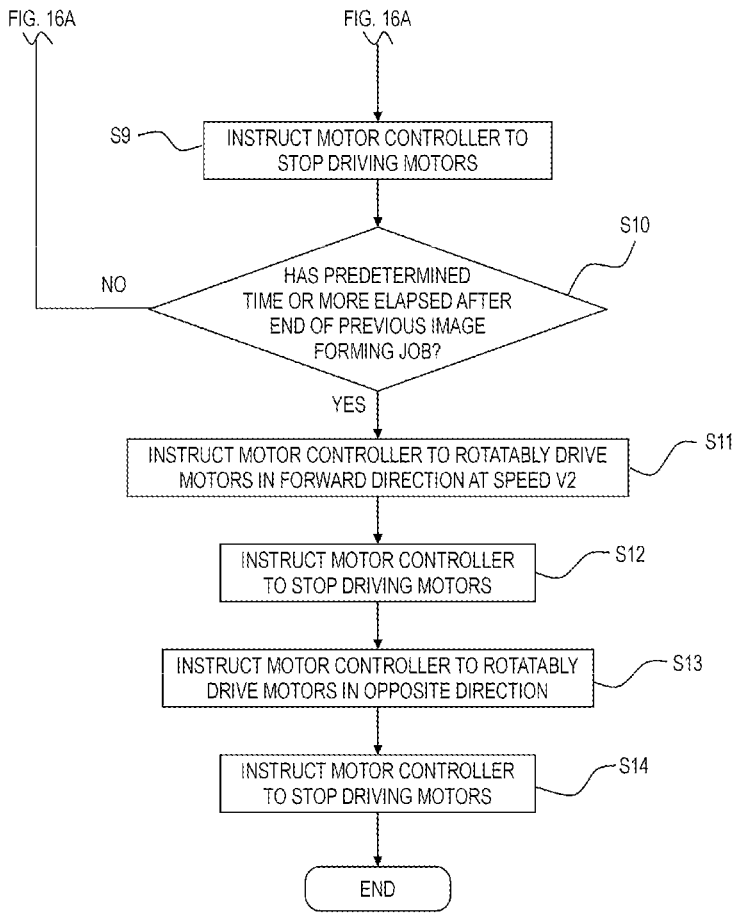

As illustrated in FIGS. 16A and 16B, first, upon receiving an image forming job signal via the user interface portion 56, the CPU 53 controls the image forming portion 61 to perform the image forming operation (S1, S2). In this case, as a part of the control of the image forming portion 61, the CPU 53 instructs the motor controller 59 to rotatably drive the motors 92*a* and 92*b* at a speed V1 (first speed) in the rotation direction (first rotation direction) at the time of image formation. As a result, the motors 92*a* and 92*b* rotate forward, the photosensitive drum 26 and the developing sleeve 71 rotate in the rotation direction at the time of image formation, and an image is formed on the sheet S. In the present embodiment, the speed V1 causes the developing sleeve 71 to rotate at 227 rpm.

Next, after the end of the image forming operation, the CPU 53 receives, from the counter 57, information of the counted value indicating the number of sheets on which an image has been formed, and determines whether or not the counted value indicating the number of sheets of A4 size on which an image has been formed is 500 or more (S3). In this case, when the counted value indicating the number of sheets on which an image has been formed is smaller than 500, the CPU 53 instructs the motor controller 59 to stop driving the motors 92*a* and 92*b* (S9), and causes the sequence to proceed to step S10.

On the other hand, when the counted value indicating the number of sheets on which an image has been formed is 500 or more, the CPU 53 stops the driving of the motors 92*a* and 92*b* via the motor controller 59 (S4). Then, the CPU 53 instructs the motor controller 59 to rotatably drive the motors 92*a* and 92*b* in the rotation direction at the time of image formation at a speed V2 (second speed) lower than the speed V1 (S5). As a result, the motors 92*a* and 92*b* rotate forward at the speed V2. Thereafter, the CPU 53 instructs the motor controller 59 to stop driving the motors 92*a* and 92*b* (S6). Further, the CPU 53 instructs the counter 57 to reset the counted value (S7).

In this case, the speed V2 does not cause the rotating members, which constitute the drive trains that transmit the driving force to the photosensitive drum 26 and the developing sleeve 71, to rotate by inertia when the motors 92*a* and 92*b* driven at the speed V2 are stopped in step S6. In the present embodiment, the speed V2 causes the developing sleeve 71 to rotate at 30 rpm.

The rotation amounts of the motors 92*a* and 92*b* in step S5 cause the play α, β, γ1, and γ2 decreased from the ideal values (maximum values) due to the effect of inertia at the time of the stop of the motors 92*a* and 92*b* in step S4 to return to the ideal values. In the present embodiment, since the play β is an angle of 30 degrees and the play γ1 and γ2 is angles of 45 degrees, the motors 92*a* and 92*b* rotate until the drive coupling 89 rotates by an angle of at least 120 degrees.

As described above, when the motors 92*a* and 92*b* rotate forward at the speed V2, the positional relationship between the couplings returns to the backlash-reduced state in the rotation direction at the time of image formation similarly to the state at the time of image formation, and the decreased play α, β, γ1, and γ2 returns to the ideal values. That is, the positional relationship between the developing coupling 75 and the drive coupling 89 changes from the state illustrated in FIG. 17A to the state illustrated in FIG. 17B, and the play β in the direction opposite to the rotation direction at the time of image formation becomes the ideal value.

Next, the CPU 53 instructs the motor controller 59 to rotatably drive the motors 92*a* and 92*b* in the rotation direction (second rotation direction) opposite to the rotation direction at the time of image formation (S8).

As a result, the motors 92*a* and 92*b* rotate reversely. The rotation amounts of the motors 92*a* and 92*b* in step S8 cause the developing sleeve 71 to rotate in a rotation allowable range in the direction opposite to the rotation direction at the time of image formation. As a result, the toner deposited in the space surrounded by the developing sleeve 71, the developing blade 72, and the scooping sheet 77 is returned to the stirring chamber 80 to suppress formation of a defective image. Thereafter, the CPU 53 instructs the motor controller 59 to stop driving the motors 92*a* and 92*b* (S9).

Next, the CPU 53 receives information from the timer 58, and determines whether a predetermined time (8 hours in the present embodiment) or more has elapsed after the end of the previous image forming job (S10). In this case, when the CPU 53 determines that 8 hours have not elapsed after the end of the previous image forming job, the sequence returns to step S1 and the CPU 53 waits to receive an image forming job signal.

On the other hand, upon determining that 8 hours or more have elapsed after the end of the previous image forming job, the CPU 53 instructs the motor controller 59 to rotatably drive the motors 92*a* and 92*b* at the speed V2 in the rotation direction at the time of image formation (S11). As a result, the motors 92*a* and 92*b* rotate forward at the speed V2. In this case, the rotation amounts of the motors 92*a* and 92*b* are the same as those in step S5, and cause the play α, β, γ1, and γ2 decreased from the ideal values due to the effect of inertia at the time of the stop of the motors 92*a* and 92*b* in step S9 to return to the ideal values. Thereafter, the CPU 53 instructs the motor controller 59 to stop driving the motors 92*a* and 92*b* (S12).

Next, the CPU 53 instructs the motor controller 59 to rotatably drive the motors 92*a* and 92*b* in the rotation direction opposite to the rotation direction at the time of image formation (S13). As a result, the motors 92*a* and 92*b* rotate reversely. The rotation amounts of the motors 92*a* and 92*b* in step S13 cause the charging roller 27 to rotate in a rotation allowable range, and do not cause the rotation amount of the developing sleeve 71 to exceed the rotation allowable range. As a result, the charging roller 27 is separated from the photosensitive drum 26, and is prevented from pressing the photosensitive drum 26 for a long time so as not to adversely affect the image quality. Thereafter, the CPU 53 instructs the motor controller 59 to stop driving the motors 92*a* and 92*b* (S14), and ends the reverse rotation sequence.

In the reverse rotation sequence, before the motors 92*a* and 92*b* are reversely rotated, the motors 92*a* and 92*b* are rotated forward at the speed V2 lower than the speed V1 at the time of image formation. With such a configuration, even in a case where the play α, β, γ1, and γ2 of each coupling decreases due to the rotation by inertia, the play α, β, γ1, and γ2 can be brought close to the ideal values before the motors 92*a* and 92*b* are reversely rotated. Therefore, when the motors 92*a* and 92*b* are reversely rotated, the operation timing of each member is prevented from being shifted, and the accuracy of the control for switching the motors 92*a* and 92*b* from the forward rotation to the reverse rotation can be prevented from deteriorating.

Although the configuration in which the motors 92*a* and 92*b* are stopped before the motors 92*a* and 92*b* are rotated forward at the speed V2 has been described in the present embodiment, the present invention is not limited thereto. That is, even in a configuration in which the speed is lowered from the speed V1 to the speed V2 without the stop of the motors 92*a* and 92*b*, and a period of time for the rotation at the speed V2 is longer than that in a configuration in which the motors 92*a* and 92*b* are stopped, the same effects as described above can be obtained.

In the present embodiment, the configuration in which the motors 92*a* and 92*b* are rotated forward at the speed V2 and then stopped has been described, but the present invention is not limited thereto. That is, even in a configuration in which the motors 92*a* and 92*b* are rotated forward at the speed V2, and then rotated reversely without the stop of the driving of the motors 92*a* and 92*b*, the same effects as described above can be obtained.

In the present embodiment, the configuration in which the Oldham coupling 1 is provided in the drive train that transmits the driving force to the developing sleeve 71 in the drive unit 90 has been described, but the present invention is not limited thereto. That is, even when the Oldham coupling 1 is provided in another portion that transmits a driving force and is, for example, the drive train that transmits the driving force to the photosensitive drum 26, the same effects as described above can be obtained.

Further, in the present embodiment, in the drive unit 90, both the photosensitive drum 26 and the developing sleeve 71 are configured to be rotatable in the direction opposite to the rotation direction at the time of image formation, but only one of the photosensitive drum 26 and the developing sleeve 71 may be configured to be rotated in the direction opposite to the rotation direction at the time of image formation. In this case, by providing the Oldham coupling 1 described above, it is possible to increase the rotation amount of either the photosensitive drum 26 or the developing sleeve 71 in the opposite direction. As a result, it is possible to selectively transmit the driving force to the drive target in a case where the motors are rotated forward and in a case where the motors are rotated reversely, and it is possible to transmit the driving force even in a state in which the rotational axes of the two rotation shafts are shifted from each other.

Further, although the present embodiment describes the configuration in which, in the Oldham coupling 1, both the protrusion 99*a* of the developing drive gear 99 and the protrusion 89*a* of the drive coupling 89 have a substantially rhombic shape, the present invention is not limited thereto. That is, one of the protrusion 99*a* of the developing drive gear 99 and the protrusion 89*a* of the drive coupling 89 may have a rectangular shape substantially identical to the recess 3*a* or the recess 3*b* of the intermediate member 3. The rotation angles of the play $\alpha$, $\beta$, $\gamma 1$, and $\gamma 2$ are not limited to the angles described in the present embodiment, and can be set to any angle.

In the present embodiment, in the Oldham coupling 1, the protrusions 99*a* and 89*a* are provided on the developing drive gear 99 and the drive coupling 89, respectively, and the recesses 3*a* and 3*b* are provided in the intermediate member 3. However, the present invention is not limited thereto. That is, the same effect as described above can be obtained by a configuration in which protrusions corresponding to the protrusions 99*a* and 89*a* are provided at one end portion and the other end portion of the intermediate member 3 in the rotational axis direction of the Oldham coupling 1, and a recess fitted to a protrusion of the intermediate member 3 is provided in each of the developing drive gear 99 and the drive coupling 89.

According to the present invention, in the image forming apparatus having the configuration in which the couplings having the play in the rotation direction are interposed in the drive trains between the motors and the driven members, it is possible to suppress deterioration in the accuracy of the control for switching the motors from the forward rotation to the reverse rotation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-206319, filed Dec. 11, 2020, which is hereby incorporated by reference herein in its entirety.

What is claimed is:

1. An image forming apparatus comprising:

a photoreceptor;

a developer carrier configured to carry a developer and develop an electrostatic latent image formed on the photoreceptor;

a motor configured to drive rotationally the photoreceptor and the developer carrier, the motor rotating in a first rotational direction and in a second rotational direction opposite to the first rotational direction, wherein the photoreceptor rotates in a third rotational direction and the developer carrier rotates in a fourth rotational direction in a state in which the motor is rotating in the first rotational direction, and the photoreceptor rotates in a direction opposite to the third rotational direction and the developer carrier rotates in a direction opposite to the fourth rotational direction in a state in which the motor is rotating in the second rotational direction;

a coupling provided in at least one of a first drive train configured to transmit drive from the motor to the developer carrier and a second drive train configured to transmit drive from the motor to the photoreceptor, the coupling including play in a rotational direction of the coupling; and a controller configured to control the motor, the controller controlling the motor to rotate in the first rotational directional in a case in which the electrostatic latent image formed on the photoreceptor is developed, wherein, in a case in which the controller controls the motor to rotate in the second rotational direction after the motor rotates in the first rotational direction, the controller controls the motor, which is stopped, to rotate in the first rotational direction, and then controls the motor to rotate in the second rotational direction.

2. The image forming apparatus according to claim 1, wherein the controller controls the motor to rotate in the first rotational direction at a first speed in the case in which the case in which the electrostatic latent image formed on the photoreceptor is developed, and wherein, in the case in which the controller controls the motor to rotate in the second rotational direction after the motor rotates in the first rotational direction, the controller controls the motor, which is stopped, to rotate in the first rotational direction at a second speed lower than the first speed, and then controls the motor to rotate in the second rotational direction.

3. The image forming apparatus according to claim 1, wherein, in the case in which the controller controls the motor rotating in the first rotational direction at a first speed to rotate in the second rotational direction, the controller controls the motor rotating in the first rotational direction at the first speed to rotate in the first rotational direction at a second speed lower than the first speed, then controls the motor to stop, and then controls the motor to rotate in the second rotational direction.

4. The image forming apparatus according to claim 1, wherein the controller controls the motor to rotate in the second rotational direction in a case in which the number of sheets on which an image is formed by the image forming apparatus becomes greater than a predetermined number.

5. The image forming apparatus according to claim 4, further comprising:

a charging roller configured to rotate in contact with the photoreceptor and charge the photoreceptor; and a separating member configured to separate the charging roller from the photoreceptor in accordance with the rotation of the motor in the second rotational direction, wherein the controller is able to rotate the motor in the second rotational direction by a first predetermined amount to rotate the developer carrier in the fourth rotational direction without causing the separating member to operate to separate the charging roller from the photoreceptor.

6. The image forming apparatus according to claim 5, wherein the charging roller rotates following the rotation of the photoreceptor, and wherein the separating member moves in conjunction with the rotation of the charging roller in a state in which the motor rotates in the second rotational direction, and separates the charging roller from the photoreceptor.

7. The image forming apparatus according to claim 5, wherein the controller controls the motor to rotate in the second rotational direction by a second predetermined amount greater than the first predetermined amount to rotate the developer carrier in the fourth direction and to cause the separating member to operate to separate the charging roller from the photoreceptor, and the play of the coupling after the motor rotates by the second predetermined amount in the second rotational direction is less than the play of the coupling after the motor rotates by the first predetermined amount in the second rotation rotational direction.

8. The image forming apparatus according to claim 1, further comprising:

a charging roller configured to rotate in contact with the photoreceptor and charge the photoreceptor; and a separating member configured to separate the charging roller from the photoreceptor in accordance with the rotation of the motor in the second rotational direction, wherein the controller controls the motor to rotate in the second rotational direction in a case in which a predetermined time has elapsed after the image forming apparatus stops an image forming operation.

9. The image forming apparatus according to claim 8, wherein the charging roller rotates following the rotation of the photoreceptor, and the separating member moves in conjunction with the rotation of the charging roller in a state in which the motor rotates in the second rotational direction, and separates the charging roller from the photoreceptor.

10. The image forming apparatus according to claim 1, wherein the coupling is an Oldham coupling.

11. The image forming apparatus according to claim 10, wherein the Oldham coupling is provided in a drive train that transmits drive from the motor to the developer carrier.

12. The image forming apparatus according to claim 10, wherein the Oldham coupling includes a first hub, a second hub, and an intermediate member that transmits a driving force between the first hub and the second hub, one of the intermediate member and the first hub has a first recess formed in an end surface of the Oldham coupling in a rotational axis direction of the Oldham coupling, recessed in the rotational axis direction, and extending in a first direction orthogonal to the rotational axis direction, and the first recess has a first inner wall on one side in a second direction orthogonal to the rotational axis direction and the first direction and a second inner wall provided on the other side in the second direction and extending parallel to the first inner wall, the other of the intermediate member and the first hub has a first protrusion that protrudes in the rotational axis direction, is fitted in the first recess, and is configured to transmit a driving force between the intermediate member and the first hub, and the first protrusion includes:

a first edge configured to come into contact with the first inner wall in a state in which the Oldham coupling rotates with the rotation of the motor in the first rotational direction, a second edge configured to come into contact with the second inner wall in a state in which the Oldham coupling rotates with the rotation of the motor in the first rotational direction, a third edge configured to come into contact with the first inner wall in a state in which the Oldham coupling rotates with the rotation of the motor in the second rotational direction, and a fourth edge configured to come into contact with the second inner wall in a state in which the Oldham coupling rotates with the rotation of the motor in the second rotational direction, the third edge is separated from the first inner wall and the fourth edge is separated from the second inner wall in a state in which the first edge is in contact with the first inner wall and the second edge is in contact with the second inner wall, the first edge is separated from the first inner wall and the second edge is separated from the second inner wall in a state in which the third edge is in contact with the first inner wall and the fourth edge is in contact with the second inner wall, in a state in which the Oldham coupling rotates with the rotation of the motor in the second rotational direction, a portion of the first edge farthest from a first rotation center which is a rotation center of the first hub in the first direction is positioned closer to the second inner wall than to the first rotation center in the second direction, and a portion of the second edge farthest from the first rotation center in the first direction is positioned closer to the first inner wall than to the first rotation center in the second direction, and in a state in which the Oldham coupling rotates with the rotation of the motor in the first rotational direction, a portion of the third edge farthest from the first rotation center in the first direction is positioned closer to the second inner wall than to the first rotation center in the second direction, and a portion of the fourth edge farthest from the first rotation center in the first direction is positioned closer to the first inner wall than to the first rotation center in the second direction.

13. The image forming apparatus according to claim 12, wherein in the Oldham coupling, the first protrusion has a shape in which a substantially rhombus is formed by an imaginary line connecting the first edge, the second edge, the third edge, and the fourth edge as viewed from the rotational axis direction.

14. The image forming apparatus according to claim 12, wherein in the Oldham coupling, one of the intermediate member and the second hub has a second recess formed in an end surface in the rotational axis direction, recessed in the rotational axis direction, and extending in the second direction, and the second recess has a third inner wall on one side in the first direction and a fourth inner wall provided on the other side in the first direction and extending parallel to the first inner wall, the other of the intermediate member and the second hub has a second protrusion protruding in the rotational axis direction, the second protrusion is fitted in the second recess and configured to transmit a driving force between the intermediate member and the second hub, and the second protrusion includes:

a fifth edge configured to come into contact with the third inner wall in a state in which the Oldham coupling rotates with the rotation of the motor in the first rotational direction, a sixth edge configured to come into contact with the fourth inner wall in a state in which the Oldham coupling rotates with the rotation of the motor in the first rotational direction, a seventh edge configured to come into contact with the third inner wall in a state in which the Oldham coupling rotates with the rotation of the motor in the second rotational direction, and an eighth edge configured to come into contact with the fourth inner wall in a state in which the Oldham coupling rotates with the rotation of the motor in the second rotational direction, wherein the seventh edge is separated from the third inner wall and the eighth edge is separated from the fourth inner wall in a state in which the fifth edge is in contact with the third inner wall and the sixth edge is in contact with the fourth inner wall, the fifth edge is separated from the third inner wall and the eighth edge is separated from the fourth inner wall in a state in which the seventh edge is in contact with the third inner wall and the eighth edge is in contact with the fourth inner wall, in a state in which the Oldham coupling rotates with the rotation of the motor in the second rotational direction, a portion of the fifth edge farthest from a second rotation center which is a rotation center of the second hub in the second direction is positioned closer to the fourth inner wall than to the second rotation center in the first direction, and a portion of the sixth edge farthest from the second rotation center in the second direction is positioned closer to the third inner wall than to the second rotation center in the first direction, and in a state in which the Oldham coupling rotates with the rotation of the motor in the first rotational direction, a portion of the seventh edge farthest from the second rotation center in the second direction is positioned closer to the fourth inner wall than to the second rotation center in the first direction, and a portion of the eighth edge farthest from the second rotation center in the second direction is positioned closer to the third inner wall than to the second rotation center in the first direction.

15. The image forming apparatus according to claim 14, wherein in the Oldham coupling, the second protrusion has a shape in which a substantially rhombus is formed by an imaginary line connecting the fifth edge, the sixth edge, the seventh edge, and the eighth edge as viewed from the rotational axis direction.

16. The image forming apparatus according to claim 1, wherein the photoreceptor and the developer carrier are integrated as an image forming unit, and the image forming unit is configured to be detachably attachable to the image forming apparatus.

* * * * *